US010113812B2

(12) United States Patent
Mabuchi et al.

(10) Patent No.: US 10,113,812 B2
(45) Date of Patent: Oct. 30, 2018

(54) HEAT EXCHANGER AND MANUFACTURING METHOD THEREOF

(71) Applicant: DENSO CORPORATION, Kariya, Aichi-pref. (JP)

(72) Inventors: Shinta Mabuchi, Nagoya (JP); Hajime Sugito, Nagoya (JP); Hideyuki Ota, Anjo (JP); Masato Itou, Nichio (JP); U Ou, Nagoya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 372 days.

(21) Appl. No.: 14/768,101

(22) PCT Filed: Feb. 14, 2014

(86) PCT No.: PCT/JP2014/000745

§ 371 (c)(1),
(2) Date: Aug. 14, 2015

(87) PCT Pub. No.: WO2014/125825

PCT Pub. Date: Aug. 21, 2014

(65) Prior Publication Data

US 2016/0025424 A1 Jan. 28, 2016

(30) Foreign Application Priority Data

Feb. 18, 2013 (JP) ..... 2013-029152
Feb. 18, 2013 (JP) ..... 2013-029153

(51) Int. Cl.
*F28F 1/22* (2006.01)
*F28F 1/12* (2006.01)
*F28D 1/053* (2006.01)

(52) U.S. Cl.
CPC ..... *F28F 1/128* (2013.01); *F28D 1/05366* (2013.01); *F28F 2215/08* (2013.01)

(58) Field of Classification Search
CPC ..... F28F 1/128
(Continued)

(56) References Cited

U.S. PATENT DOCUMENTS 3,250,325 A * 5/1966 Rhodes et al. ..... F28F 1/128 165/153
3,724,538 A * 4/1973 Yamaguchi ..... B21D 13/04 165/152

(Continued)

FOREIGN PATENT DOCUMENTS

JP S5098365 U 8/1975
JP H02045375 U 3/1990

(Continued)

OTHER PUBLICATIONS

International Search Report and Written Opinion (in Japanese with English Translation) for PCT/JP2014/000745, dated May 20, 2014; ISA/JP.

*Primary Examiner* — Allen Flanigan
(74) *Attorney, Agent, or Firm* — Harness, Dickey & Pierce, P.L.C.

(57) ABSTRACT

In a heat exchanger, when louvers are viewed from an airflow direction, a louver tip end width becomes shorter with increase of a louver height. A fin width of the fin is 14 mm or shorter. Airflow-end louver lengths of an upstream-end first louver, a downstream-end first louver, an upstream-end second louver, and a downstream-end second louver are "⅝×LP" or longer, where LP is a louver pitch.

17 Claims, 15 Drawing Sheets

(58) Field of Classification Search
USPC ..... 165/146, 152
See application file for complete search history.

(56) References Cited

U.S. PATENT DOCUMENTS

| | | | | |
|---|---|---|---|---|
| 5,787,972 | A * | 8/1998 | Beamer et al. | F28F 1/128 165/152 |
| 6,439,300 | B1 * | 8/2002 | Falta et al. | F25B 39/02 165/152 |
| 9,316,446 | B2 * | 4/2016 | Yoshioka et al. | F28F 1/325 |
| 2002/0195235 | A1 * | 12/2002 | Falta et al. | F25B 39/02 165/152 |
| 2003/0079868 | A1 | 5/2003 | Bouzida et al. | |
| 2003/0136554 | A1 | 7/2003 | Hu et al. | |
| 2004/0206484 | A1 | 10/2004 | Shimoya et al. | |
| 2007/0051502 | A1 * | 3/2007 | Yamauchi | F28F 1/128 165/151 |
| 2007/0144714 | A1 | 6/2007 | Yabe et al. | |
| 2007/0209786 | A1 | 9/2007 | Shimoya et al. | |
| 2010/0243224 | A1 * | 9/2010 | Jianlong et al. | F28F 1/128 165/173 |
| 2011/0315362 | A1 * | 12/2011 | Jiang et al. | F28D 1/05375 165/173 |
| 2014/0224462 | A1 | 8/2014 | Kamada et al. | |

FOREIGN PATENT DOCUMENTS

| | | | |
|---|---|---|---|
| JP | H04139386 | A | 5/1992 |
| JP | H10185478 | A | 7/1998 |
| JP | H11157326 | A | 6/1999 |
| JP | 2005003350 | A | 1/2005 |
| JP | 2005121348 | A | 5/2005 |
| JP | 2005201492 | A | 7/2005 |
| JP | 2006266628 | A | 10/2006 |
| JP | 2007010180 | A | 1/2007 |
| JP | 2007178015 | A | 7/2007 |
| JP | 2008209025 | A | 9/2008 |
| JP | 2012237537 | A | 12/2012 |

* cited by examiner

FIG. 11 COMPARATIVE EXAMPLE

HEAT EXCHANGER AND MANUFACTURING METHOD THEREOF

CROSS REFERENCE TO RELATED APPLICATIONS

This application is a U.S. National Phase Application under 35 U.S.C. 371 of International Application No. PCT/JP2014/000745 filed on Feb. 14, 2014 and published in Japanese as WO 2014/125825 A1 on Aug. 21, 2014. This application is based on and claims the benefit of priority from Japanese Patent Applications No. 2013-029153 filed on Feb. 18, 2013, and No. 2013-029152 filed on Feb. 18, 2013. The entire disclosures of all of the above applications are incorporated herein by reference.

TECHNICAL FIELD

The present disclosure relates to a heat exchanger including tubes and a heat-exchange promotion fin and to a manufacturing method of the heat exchanger.

BACKGROUND ART

An existing heat exchanger includes multiple tubes for a first fluid to flow and fins which promote heat exchange between the first fluid and a second fluid that flows around the tubes along one direction. Such a heat exchanger is disclosed, for example, in Patent Document 1. In the heat exchanger of Patent Document 1, each fin includes a plate-like planar portion along the one direction and multiple louvers which are parallel to one another and twisted up so as to incline with respect to the planar portion.

The second fluid flows a clearance between every pair of the adjacent louvers. A louver interval between some of the louvers is made wider than a louver interval between the other louvers. Hence, when viewed in the one direction, a louver height from the planar portion is not equal in all of the louvers. The louver height becomes higher as the louver interval becomes wider in one of a pair the louvers between which the louver interval is formed.

In the heat exchanger of Patent Document 1, the fin includes multiple louvers which are parallel to one another and twisted up so as to incline with respect to the one direction. The second fluid flows a clearance between every pair of the adjacent louvers and an interval between some of the louvers is made wider than an interval between the other louvers.

PRIOR ART DOCUMENT

Patent Document

Patent Document 1: JP H11-157326 A

SUMMARY OF THE INVENTION

Typically, the louver height is equal in all of the louvers provided to the fins of the heat exchanger. However, it is considered from a study conducted by the inventor of the present disclosure that the louver height cannot be set equal in all of the louvers in some cases as disclosed in Patent Document 1 when heat exchange performance of the heat exchanger is to be enhanced.

When a fin provided with the louvers not all of which have an equal louver height is processed by a typical fin shaping method, for example, roller shaping, it is anticipated that the fin undergoes unnecessary shape deformation due to a difference of the louver heights among the louvers. The shape deformation has an influence on fin performance and an air current and may possibly become a cause of deterioration in heat exchange performance of the heat exchanger. Further, a faulty fin may possibly be shaped.

The heat exchanger of Patent Document 1 is improved by making an interval between some of the louvers wider than an interval between the other louvers, so that the second fluid flowing a clearance between the louvers at the wider interval hardly stagnates. However, a study conducted by the inventor of the present disclosure reveals that Patent Document 1 fails to explicitly describe a relation of a width of the fin in the one direction and shapes of the respective louvers provided to the fin.

As the width of the fin becomes narrower, in particular, the louvers become finer and hence a clearance between the louvers becomes smaller. Accordingly, the second fluid more readily stagnates in a clearance between the louvers as the width of the fin becomes narrower. Hence, as the width of the fin becomes narrower, it is considered more critical to clearly describe a relation of the width of the fin and shapes of the respective louvers provided to the fin in obtaining satisfactory heat exchange performance.

In view of the foregoing, it is an objective of the present disclosure is to provide a heat exchanger capable of obtaining a satisfactory heat exchange performance by including a fin in which unnecessary shape deformation is limited in shaping of the fin, and a manufacturing method of the heating exchanger.

It is another objective of the present disclosure to provide a heat exchanger capable of obtaining a satisfactory heat exchange performance while reducing a fin width.

According to a first aspect of the present disclosure, a heat exchanger includes tubes through which a first fluid flows, and a fin bonded to the tubes to promote heat exchange between the first fluid and a second fluid that flows along one direction through spaces among the tubes. The fin includes a planar portion having a plate-like shape along the one direction, and louvers aligned in the one direction on the planar portion and inclined with respect to the planar portion. The louvers include a higher louver and a lower louver that is lower than the higher louver in a louver height from the planar portion to a tip end of the louver. The higher louver is shorter than the lower louver in a length at the tip end along the planar portion, and each of the louvers has tip end corners, at which the tip end intersects with a side end, on both sides of each of the louvers. The tip end corners located on a same side of the louvers are positioned on a same flat plane parallel to the one direction.

When viewed in the one direction, the length at the tip end of the louver becomes shorter with increase of the louver height. Therefore, assuming that the fin is shaped, for example, by roller shaping which is a typical fin shaping method, the cutting blades to shape the respective louvers come into contact with a raw material of the fin, and a lag in contact starting time of the cutting blades becomes smaller. For example, multiple louver-shaping cutting blades start to cut in the raw material of the fin substantially at the same time. The heat exchanger thus includes a fin in which unnecessary shape deformation is limited in shaping, and therefore a satisfactory heat exchange performance can be obtained.

According to a second aspect of the present disclosure, a method for manufacturing a heat exchanger is disclosed. The heat exchanger includes tubes through which a first fluid flows, and a fin bonded to the tubes to promote heat exchange between the first fluid and a second fluid that flows along one direction through spaces among the tubes. The fin includes a planar portion having a plate-like shape along the one direction, and louvers aligned in the one direction on the planar portion and inclined with respect to the planar portion. The manufacturing method includes a step of manufacturing the fin by a roller shaping method. The step includes a fin shaping step of making a fin material into a corrugated shape and shaping the louvers by letting the fin material be bitten by a pair of gear-like shaping rollers. The fin shaping step includes using the shaping rollers including louver-shaping cutting blades aligned in a row in an axial direction of the shaping rollers. The louver-shaping cutting blades includes a high cutting blade and a low cutting blade that is lower than the high cutting blade in a cutting blade height from a tooth flank to a cutting blade tip end. The high cutting blade is shorter than the low cutting blade in a length at the cutting blade tip end. The fin shaping step includes shaping the louvers by making the louver-shaping cutting blades start to cut in the fin material at same timing with one another.

According to the discourse as above, the shaping rollers including multiple louver-shaping cutting blades having different cutting blade heights are used in the fin shaping step. Hence, multiple louvers having different louver heights can be shaped. The shaping rollers include the multiple louver-shaping cutting blades in which the high cutting blade having a high cutting blade height has a short length at the cutting blade tip end in comparison with the low cutting blade having a low cutting blade height. Since the multiple louver-shaping cutting blades start to cut in the fin material at the same timing with one another, the louver-shaping cutting blades mutually cancel out pulling-in of the fin material that occurs when the louver-shaping cutting blades cut in the fin material. Hence, the present disclosure has an advantage that the fin material hardly undergoes deformation in a direction in which the louver-shaping cutting blades are aligned, namely, an axial direction of the shaping rollers.

The shaping rollers used in the fin shaping step include the high cutting blade and the low cutting blade and the length at the cutting blade tip end is shorter in the high cutting blade than in the low cutting blade. Consequently, the multiple louvers are shaped in such a manner that the multiple louvers include louvers having different louver heights and the higher louver having a high louver height among the multiple louvers has a short length at the tip end of the louver in comparison with the lower louver having a low louver height.

According to the third aspect of the present disclosure, a heat exchanger includes tubes through which a first fluid flows, and a fin bonded to the tubes to promote heat exchange between the first fluid and a second fluid that flows along one direction through spaces among the tubes. The fin includes a first flat portion, a second flat portion and a third flat portion disposed sequentially from upstream in a flow of the second fluid in the one direction. The fin includes first louvers aligned in the one direction between the first flat portion and the second flat portion and inclined with respect to the one direction, and second louvers aligned in the one direction between the second flat portion and the third flat portion at a louver pitch equal to a louver pitch of the first louvers and inclined with respect to the one direction in an opposite orientation to the first louvers. A length of the fin in the one direction is shorter than or equal to 14 mm. The first louvers include an upstream-end first louver connected to the first flat portion. The second louvers include an upstream-end second louver connected to the second flat portion. A louver length in the one direction of each of the upstream-end first louver and the upstream-end second louver is longer than or equal to $\frac{5}{8}\times LP$, where LP is the louver pitch.

The louver lengths of the upstream-end first louver and the upstream-end second louver are set to $\frac{5}{8}\times LP$ or longer. Hence, wide clearances are secured between the upstream-end first louver and adjacent first louver and between the upstream-end second louver and adjacent second louver according to the louver lengths. The second fluid thus hardly stagnates in these clearances in which the second fluid readily stagnates otherwise when the fin width is 14 mm or shorter. Hence, a satisfactory heat exchange performance of the heat exchanger can be obtained while the heat exchanger is made more compact by reducing the width of the fin of the heat exchanger to 14 mm or shorter.

The phrase, "the first louvers and the second louvers have an equal louver pitch", referred to in the disclosure above does not means that the louver pitches are equal in mathematical term but means that the louver pitches are substantially equal by taking a manufacturing variation into consideration.

According to a fourth aspect of the present disclosure, a heat exchanger includes tubes through which a first fluid flows, and a fin bonded to the tubes to promote heat exchange between the first fluid and a second fluid that flows along one direction through spaces among the tubes. The fin includes a first flat portion, a second flat portion and a third flat portion disposed sequentially from upstream in a flow of the second fluid in the one direction. The fin includes first louvers aligned in the one direction between the first flat portion and the second flat portion and inclined with respect to the one direction, and second louvers aligned in the one direction between the second flat portion and the third flat portion at a louver pitch equal to a louver pitch of the first louvers and inclined with respect to the one direction in an opposite orientation to the first louvers. The first louvers include an upstream-end first louver connected to the first flat portion, a downstream-end first louver connected to the second flat portion, and an intermediate first louver located between the upstream-end first louver and the downstream-end first louver. The second louvers include an upstream-end second louver connected to the second flat portion, a downstream-end second louver connected to the third flat portion, and an intermediate second louver located between the upstream-end second louver and the downstream-end second louver. The upstream-end first louver, the downstream-end first louver, the upstream-end second louver and the downstream-end second louver are larger in an inclination angle with respect to the one direction than the intermediate first louver and the intermediate second louver.

The upstream-end first louver, the downstream-end first louver, the upstream-end second louver, and the downstream-end second louver are provided so as to have a large inclination angle in comparison with the intermediate first louver and the intermediate second louver. Hence, inter-louver passages tangent to the upstream-end first louver, the downstream-end first louver, the upstream-end second louver, and the downstream-end second louver become wider. Consequently, air can be made to hardly stagnate where air generally stagnates easily, and a heat exchange performance of the heat exchanger can be enhanced.

According to a fifth aspect of the present disclosure, a heat exchanger includes tubes through which a first fluid flows, and a fin bonded to the tubes to promote heat exchange between the first fluid and a second fluid that flows along one direction through spaces among the tubes. The fin includes a first flat portion, a second flat portion and a third flat portion, each of which has a plate-like shape, disposed sequentially from upstream in a flow of the second fluid in the one direction. The fin includes first louvers aligned in the one direction between the first flat portion and the second flat portion and inclined with respect to the one direction, second louvers aligned in the one direction between the second flat portion and the third flat portion at a louver pitch equal to a louver pitch of the first louvers and inclined with respect to the one direction in an opposite orientation to the first louvers, and a connection portion having plate-like shape and extending in the one direction, the connection portion integrally connecting the first flat portion, the first louvers, the second flat portion, the second louvers and the third flat portion. Each of the first flat portion, the second flat portion and the third flat portion is disposed so as to be displaced from the connection portion in a thickness direction of the connection portion. The first louvers define first inter-louver passages between the first louvers such that passages of the first inter-louver passages which are positioned on an uppermost stream side and a lowermost stream side in an air flow are wider than other passages of the first inter-louver passages. The second louvers define second inter-louver passages between the second louvers such that passages of the second inter-louver passages, which are positioned on an uppermost stream side and a lowermost stream side in the air flow, are wider than other passages of the second inter-louver passages.

As has been described, the passages of the first inter-louver passages on the uppermost stream side and the lowermost stream side in the air current are wider than the other first inter-louver passages. The passages of the second inter-louver passages on the uppermost stream side and the lowermost stream side in the air current are wider than the other second inter-louver passages. Consequently, air can be made to hardly stagnate where air generally stagnates easily, and a heat exchange performance of the heat exchanger can be enhanced.

EMBODIMENTS FOR EXPLOITATION OF THE INVENTION

Figure 1:
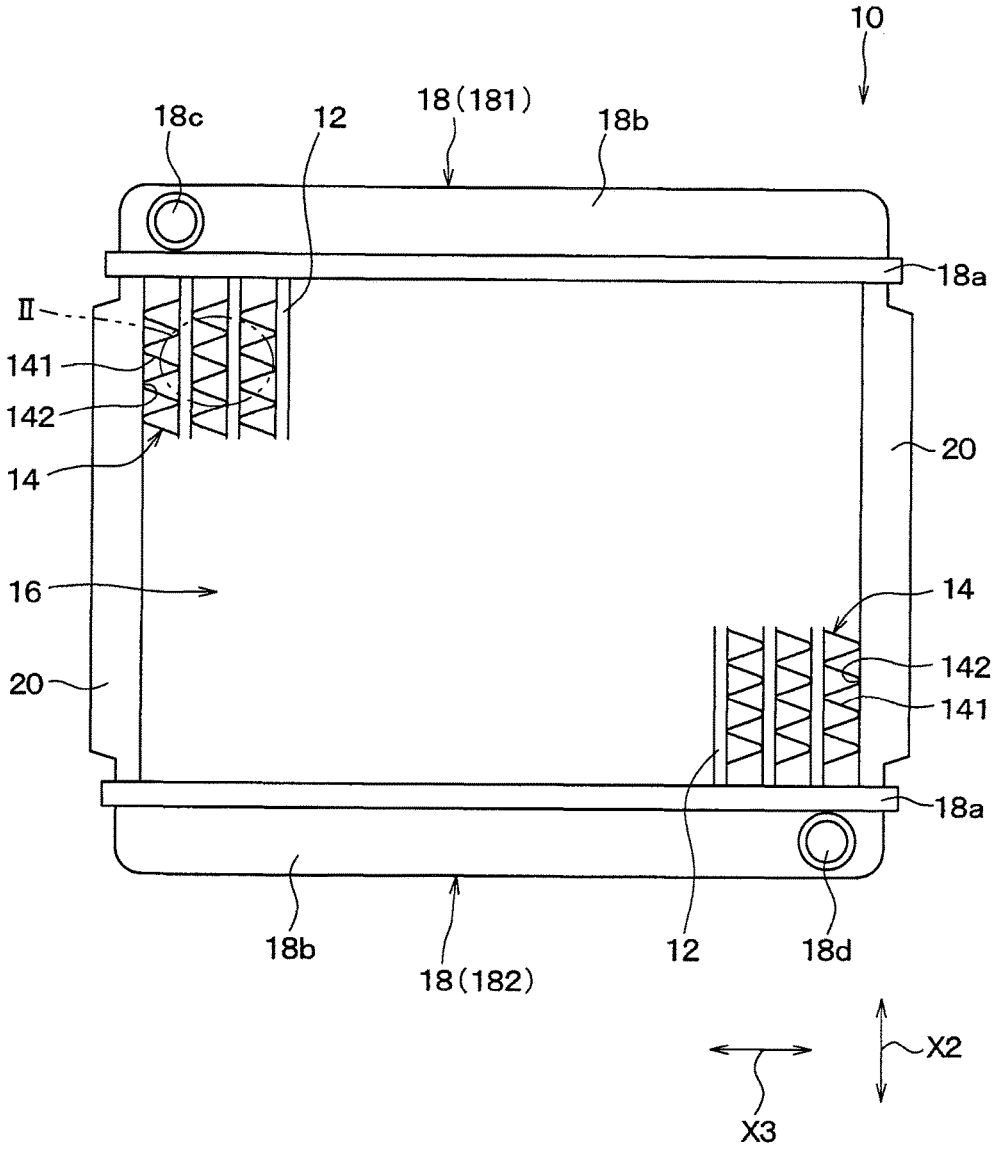
FIG. 1 is a front view illustrating a radiator according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Hereinafter, embodiments of the present disclosure will be described according to the drawings. Among the respective embodiments below, same or equivalent portions are labeled with same reference numerals in the drawings.

First Embodiment

FIG. 1 is a front view of a radiator 10 of the present embodiment. The radiator 10 is, for example, a vehicle heat exchanger that cools an engine or an electric motor that runs a vehicle. The present embodiment describes an example where the present disclosure is applied to the radiator 10. It should be appreciated, however, that the present disclosure may be applied to other heat exchangers, such as an evaporator and a heater core in an air conditioner.

As is shown in FIG. 1, the radiator 10 includes a tube 12 which is a pipe for a coolant as a first fluid to flow. The tube 12 is formed to have a flat oval cross section so that a longitudinal diameter direction coincides with a flow direction X1 of air as a second fluid, namely, an airflow direction X1 (see FIG. 2). Also, the tube 12 includes multiple tubes 12 which are disposed parallel to one another in a horizontal direction so that a longitudinal direction coincides with a vertical direction.

Fins 14 as a heat-transfer member formed in a corrugated shape are bonded to flat surfaces of the tube 12 on both sides. The fins 14 increase a heat-transfer area for air flowing around the tubes 12 along the airflow direction X1. The fins 14 thus promote heat exchange between the coolant and air. Hereinafter, a heat exchange portion of substantially a rectangular shape made up of the tubes 12 and the fins 14 is referred to as a core portion 16.

Figure 2:
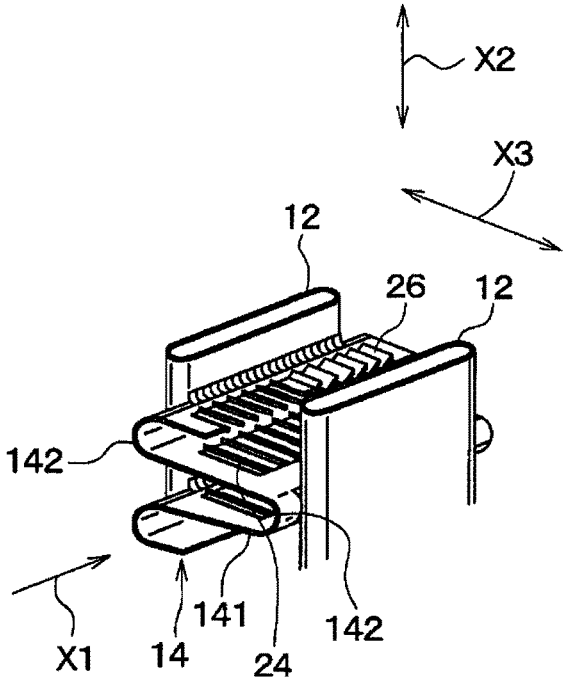
FIG. 2 is an enlarged perspective view of a part II in FIG. 1.

Header tanks 18 are provided to the tubes 12 at ends on the both sides in a longitudinal direction X2 of the tubes 12, namely, a tube longitudinal direction X2. In short, two header tanks 18 are provided. The header tanks 18 are provided so as to extend in a direction X3 in which the multiple tubes 12 are laminated, namely, a tube lamination direction X3. The header tanks 18 communicate with the multiple tubes 12. The tube longitudinal direction X2 and the tube lamination direction X3 shown in FIG. 1 are orthogonal to each other. The airflow direction X1 shown in FIG. 2 is orthogonal to both of the tube longitudinal direction X2 and the tube lamination direction X3. The airflow direction X1 corresponds to one direction of the present disclosure.

Each header tank 18 is formed of a core plate 18*a* into which the tubes 12 are inserted and bonded and a tank main body portion 18*b* that defines a tank inner space together with the core plate 18*a*. In the present embodiment, the core plate 18*a* is made of metal, for example, aluminum alloy, and the tank main body portion 18*b* is made of resin. Inserts 20 that extend substantially parallel to the tube longitudinal direction X2 to reinforce the core portion 16 are provided at both ends of the core portion 16.

Of the two header tanks 18, an inlet-side tank 181 disposed on an upper side and distributing the coolant to the tubes 12 is provided with an inlet pipe 18*c* in the tank main body portion 18*b* to let the coolant, which has cooled, for example, the engine, flow into the tank main body portion 18*b*. Also, of the two header tanks 18, an outlet-side tank 182 disposed on a lower side and collecting the coolant flowing out from the tubes 12 is provided with an outlet pipe 18*d* in the tank main body portion 18*b* to let the coolant, which has been cooled through heat exchange with air, flow out from the radiator 10.

When the radiator 10 is mounted to the vehicle, for example, an air-current upstream side in the airflow direction X1 is a vehicle front side and the tube longitudinal direction X2 is a vehicle up-down direction.

FIG. 2 is an enlarged perspective view showing an enlarged part of the fin 14, that is, an enlarged perspective view showing an enlarged part II of FIG. 1. As is shown in FIG. 2, the fin 14 is a corrugated fin formed in a corrugated shape so as to have sheet-like plate portions 141 and ridge portions 142 that position adjacent plate portions 141 apart from each other by a predetermined distance. The plate portions 141 provide surfaces along the airflow direction X1. The plate portions 141 can be provided by a flat plate and are therefore occasionally referred to also as a planar portion 141 in the description below.

The ridge portions 142 are bonded to the flat surfaces of the tubes 12 by, for example, brazing. The fin 14 is thus bonded to the tubes 12 and becomes capable of transferring heat. The ridge portions 142 are curved portions each having an arc-like cross section when viewed in the airflow direction X1. The ridge portions 142 are therefore occasionally referred to also as curved portions 142 in the description below.

The fin 14 having the corrugated shape is shaped by applying a roller shaping method to a thin-sheet of metal material made, for example, of aluminum alloy.

Figure 3:
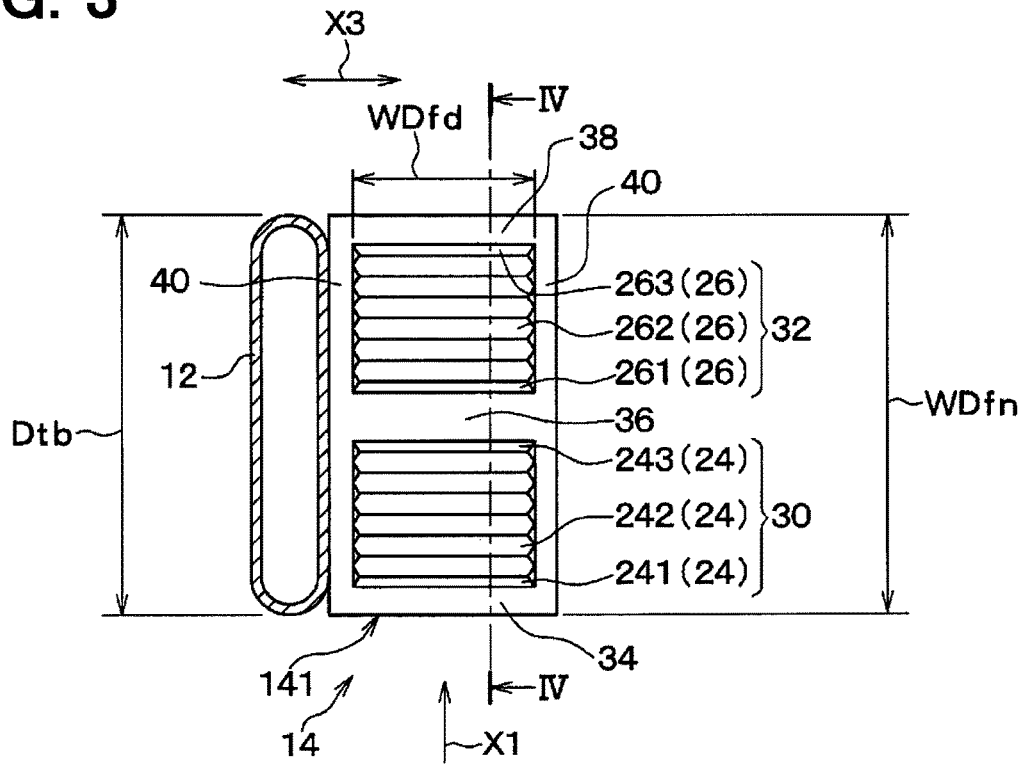
FIG. 3 is a partially sectional view of a tube and a fin of the radiator of the first embodiment.
Figure 4:
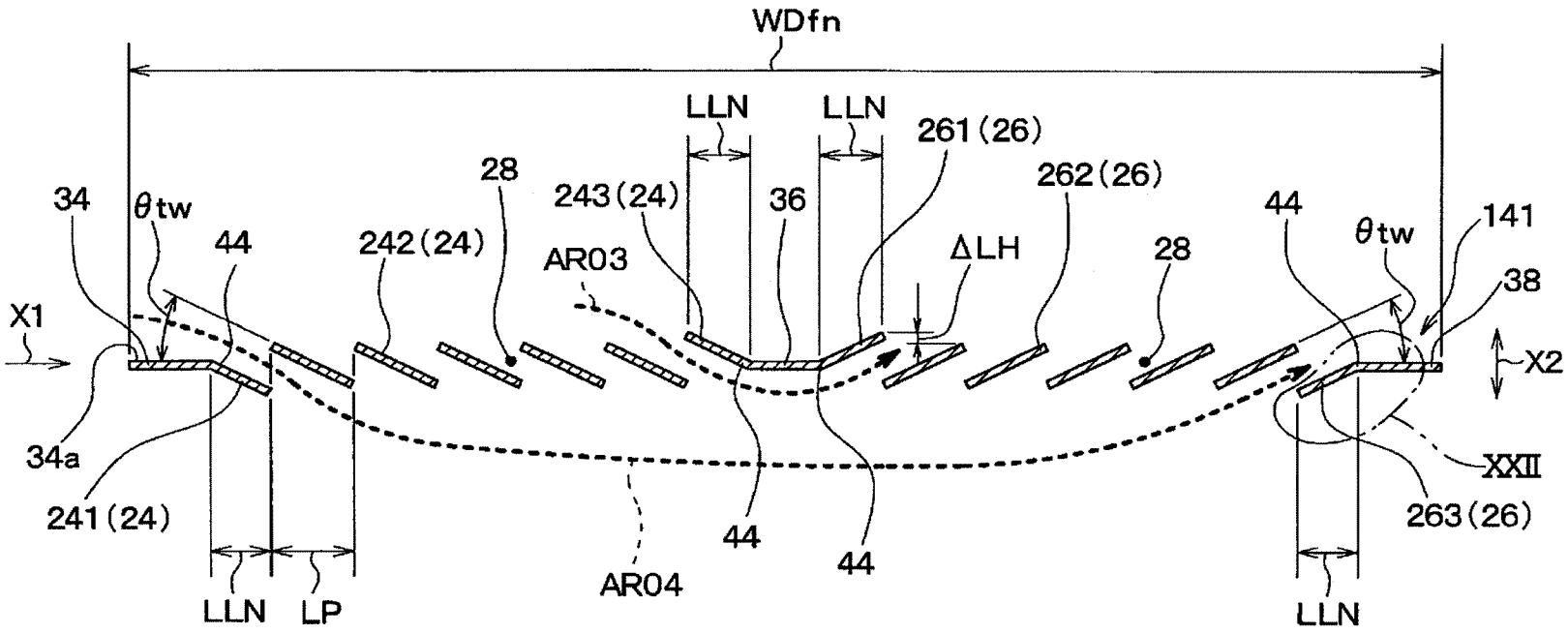
FIG. 4 is a sectional view taken along a line IV-IV of FIG. 3 and FIG. 5.

FIG. 3 is a sectional view of the tube 12 and the fin 14 when viewed in the tube longitudinal direction. FIG. 4 is a sectional view of the fin 14 when viewed in a direction orthogonal to a thickness direction of the plate portion 141 and the airflow direction X1, that is, a sectional view taken along the line IV-IV of FIG. 3 and FIG. 5. As are shown in FIG. 3 and FIG. 4, the fin 14 includes louvers 24 and 26 shaped like a blind window together with the planar portion 141. The louvers 24 and 26 are provided integrally with the planar portion 141, to be more specific, provided by cutting and raising the planar portions 141. In other words, the louvers 24 and 26 are provided by being twisted up so as to incline with respect to the airflow direction X1.

More specifically, as is shown in FIG. 4, when viewed in the direction orthogonal to the thickness direction of the planar portion 141 and the airflow direction X1, the louvers 24 and 26 are twisted at a predetermined twist angle θtw with respect to the planar portion 141. In other words, the louvers 24 and 26 are twisted by the predetermined twist angle θtw with respect to the airflow direction X1. The louvers 24 and 26 include multiple louvers 24 and multiple louvers 26, respectively, which are provided to the planar portion 141 along the airflow direction X1. In other words, the multiple louvers 24 and 26 aligned in a row in the airflow direction X1 are provided to each planar portion 141. An inter-louver passage 28 is provided between every pair of adjacent first louvers 24 and every pair of adjacent second louvers 26.

As is shown in FIG. 3, the multiple louvers 24 and 26 provided integrally with one planar portion 141 are divided to two louver groups in the fin 14. More specifically, the multiple louvers 24 and 26 are divided to two groups: a first louver group 30 and a second louver group 32. The first louver group 30 is an upstream louver group made up of the multiple first louvers 24 located upstream in a cooling air current. The second louver group 32 is a downstream louver group made up of the multiple second louvers 26 located downstream in the cooling air current. A width of the fin 14 in the airflow direction X1, namely, a fin width WDfn is set to 14 mm or shorter, for example, approximately 12 mm in the present embodiment.

All of the first louvers 24 are provided to be parallel to one another and all of the second louvers 26 are also provided to be parallel to one another. The twist angle θtw of the first louvers 24 is as large as the twist angle θtw of the second louvers 26 and a twist direction is opposite to a twist direction of the second louvers 26. The term, "being parallel", referred to herein for the first louvers 24 and the second louvers 26 does not mean to be parallel in a mathematical term and means to be substantially parallel by taking a manufacturing variation into consideration.

As are shown in FIG. 3 and FIG. 4, an air-current upstream end of the planar portion 141 is provided with neither the louvers 24 nor 26 and forms an upstream flat portion 34 made from a flat surface along the airflow direction X1. An air-current downstream end of the planar portion 141 forms a downstream flat portion 38 made from a flat surface same as the flat surface of the upstream flat portion 34. Also, substantially a center of the planar portion 141 in the airflow direction X1, that is, a region between the first louver group 30 and the second louver group 32 forms a center flat portion 36 made from a flat surface same as the flat surface of the upstream flat portion 34.

In other words, the fin 14 includes the upstream flat portion 34 (first flat portion), the center flat portion 36 (second flat portion), and the downstream flat portion 38 (third flat portion), and the upstream flat portion 34, the center flat portion 36, and the downstream flat portion 38 are disposed sequentially from the upstream side in the air current in the airflow direction X1. The first louvers 24 are disposed between the upstream flat portion 34 and the center flat portion 36 and aligned in the airflow direction X1 at a predetermined louver pitch LP. The second louvers 26 are disposed between the center flat portion 36 and the downstream flat portion 38 and aligned in the airflow direction X1 at the same louver pitch LP as the first louvers 24.

As is shown in FIG. 3, the planar portion 141 includes two connection portions 40. In other words, ends of the planar portion 141 on the both sides in the tube lamination direction X3 form the connection portions 40 shaped like a long narrow plate extending in the airflow direction X1. The connection portions 40 sandwich the upstream flat portion 34, the first louvers 24, the center flat portion 36, the second louvers 26, and the downstream flat portion 38 aligned in the airflow direction X1 and are disposed to form a pair in a direction orthogonal to the aligning direction. The connection portions 40 integrally connect the upstream flat portion 34, the first louvers 24, the center flat portion 36, the second louvers 26, and the downstream flat portion 38. In other words, the planar portion 141 is a single flat plate formed of the upstream flat portion 34, the center flat portion 36, the downstream flat portion 38, and the two connection portions 40.

The first louvers 24 belonging to the first louver group 30 are classified more in detail as shown in FIG. 4. That is, the first louvers 24 are classified to an upstream-end first louver 241 disposed on an air-current uppermost stream side in the airflow direction X1 among the first louvers 24, a downstream-end first louver 243 disposed on an air-current lowermost stream side, and intermediate first louvers 242 disposed between the upstream-end first louver 241 and the downstream-end first louver 243.

The upstream-end first louver 241 is connected to the upstream flat portion 34 at one end 44 in the airflow direction X1, namely, one base 44. The downstream-end first louver 243 is connected to the center flat portion 36 at the other end 44 in the airflow direction X1, namely, the other base 44.

The second louvers 26 belonging to the second louver group 32 are also classified more in detail as shown in FIG. 4. That is, the second louvers 26 are classified to an upstream-end second louver 261 disposed on an air-current uppermost stream side in the airflow direction X1 among the second louvers 26, a downstream-end second louver 263 disposed on an air-current lowermost stream side, and intermediate second louvers 262 disposed between the upstream-end second louver 261 and the downstream-end second louver 263.

The upstream-end second louver 261 is connected to the center flat portion 36 at one end 44 in the airflow direction X1, namely, one base 44. The downstream-end second louver 263 is connected to the downstream flat portion 38 at the other end 44 in the airflow direction X1, namely, the other base 44.

As is shown in FIG. 4, when viewed in the airflow direction X1, the intermediate first louvers 242 and the intermediate second louvers 262 protrude in relation to the upstream flat portion 34 to both sides in a thickness direction of the upstream flat portion 34. The downstream-end first louver 243 and the upstream-end second louver 261 protrude in relation to the upstream flat portion 34 to only one side in the thickness direction of the upstream flat portion 34. On the other hand, the upstream-end first louver 241 and the downstream-end second louver 263 protrude in relation to the upstream flat portion 34 to only the other side in the thickness direction of the upstream flat portion 34. Hence, the first louver group 30 made up of the first louvers 24 and the second louver group 32 made up of the second louvers 26 are in a symmetrical relation with each other with the center flat portion 36 in between.

Figure 5:
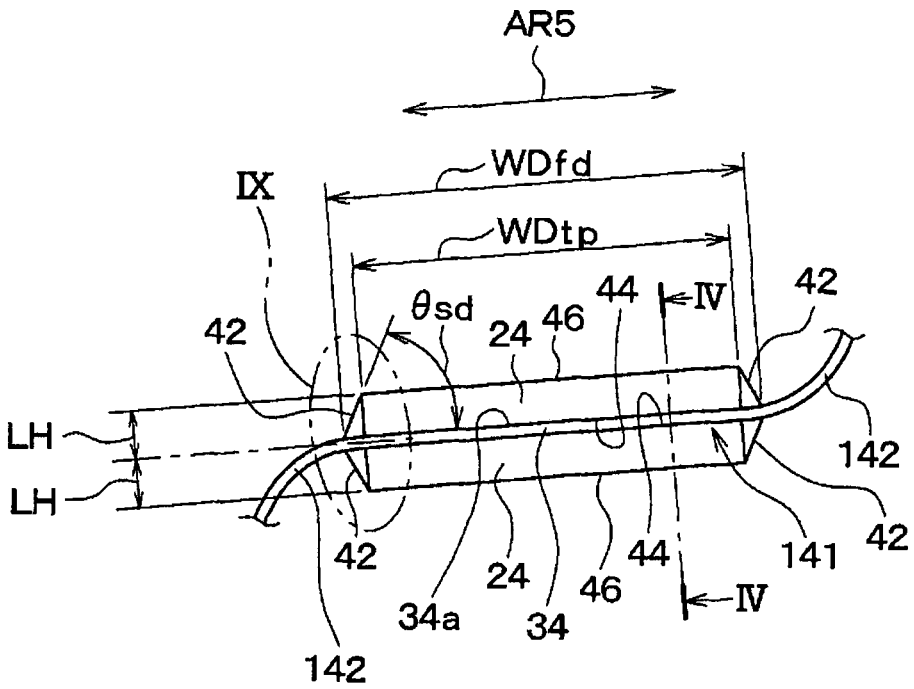
FIG. 5 is a side view of a part of a plate portion of the fin of the first embodiment.

As is shown in FIG. 5, when viewed in the airflow direction X1, each first louver 24 is provided in such a manner that a width in a direction indicated by an arrow AR5 orthogonal to the thickness direction of the upstream flat portion 34 and the airflow direction X1 becomes wider as a distance to the upstream flat portion 34 becomes shorter in the thickness direction of the upstream flat portion 34. In other words, the width of the first louver 24 in the direction indicated by the arrow AR5 becomes the shortest at a tip end 46 of the first louver 24. In other words, as is shown in FIG. 5, when the louvers 24 and 26 are viewed in the airflow direction X1, a louver side-end angle θsd between a side-end 42 of the louver 24 or 26 and the planar portion 141 is smaller than 90°.

Louver tip end widths WDtp, which are the widths in the direction indicated by the arrow AR5 at the tip ends 46, are equal to one another in all of the first louvers 24 on either side in the thickness direction of the upstream flat portion 34. The louver tip end widths WDtp correspond to a tip end width of the louvers of the present disclosure.

FIG. 5 is a partial side view of the planar portion 141 of the fin 14 when viewed in the airflow direction X1. The shape of the second louvers 26 is the same as the shape of the first louvers 24 shown in FIG. 5. When viewed in the airflow direction X1, louver base widths WDfd in the bases 44 at which the louvers 24 and 26 intersect with the planar portion 141, which are the widths of the louvers 24 and 26 in the direction indicated by the arrow AR5, are equal to one another in all of the louvers 24 and 26. Because the upstream flat portion 34, the center flat portion 36, and the downstream flat portion 38 are formed on a single plane, the thickness direction of the upstream flat portion 34 can be said as a thickness direction of the center flat portion 36, a thickness direction of the downstream flat portion 38, or a thickness direction of the planar portion 141.

The louver side-end angle θsd is also referred to as a cut-over angle θsd of the louvers 24 and 26. The louver tip end width WDtp is also referred to as an effective cut length WDtp of the louvers 24 and 26. The louver base width WDfd is also referred to as a full cut length WDfd of the louvers 24 and 26.

The multiple intermediate first louvers 242 are provided so that a louver height LH shown in FIG. 5 is equal in all of the intermediate first louvers 242. Likewise, the multiple intermediate second louvers 262 are provided so that the louver height LH is equal in all of the intermediate second louvers 262. Further, the louver height LH of the intermediate first louvers 242 is as long as the louver height LH of the intermediate second louvers 262. The term, "the louver height LH", referred to herein means a dimension in a louver height direction orthogonal to one plane 34*a* of the upstream flat portion 34 provided along the airflow direction X1, namely, a dimension in the thickness direction of the upstream flat portion 34. For example, the louver height LH is a height dimension of the louvers 24 and 26 in reference to a thickness center position of the upstream flat portion 34. In other words, the louver height LH is a louver projection height when the louvers 24 and 26 are projected in the airflow direction X1.

Louver lengths LLN (see FIG. 4) of the upstream-end first louver 241, the downstream-end first louver 243, the upstream-end second louver 261, and the downstream-end second louver 263 in the airflow direction X1, namely, airflow-end louver lengths LLN are equal to one another at all of the four points, more specifically, set to a length corresponding to the louver pitch LP.

For example, given that all of the airflow-end louver lengths LLN are expressed as [LLN=½×LP]. Then, the louver heights LH of the upstream-end first louver 241, the downstream-end first louver 243, the upstream-end second louver 261, and the downstream-end second louver 263 are equal to the louver heights LH of the intermediate first louvers 242 and the intermediate second louvers 262. In the present embodiment, however, the airflow-end louver lengths LLN at all of the four points are set to be longer than [½×LP]. Hence, the louver heights LH of the upstream-end first louver 241, the downstream-end first louver 243, the upstream-end second louver 261, and the downstream-end second louver 263 (higher louvers) are higher than the louver heights LH of the rest of the louvers 24 and 26, namely the intermediate first louvers 242 and the intermediate second louvers 262 (lower louvers). In short, some of the multiple louvers 24 and 26 have different louver heights LH. For example, FIG. 4 shows that the louver height LH of the upstream-end second louver 261 is higher than the louver height LH of the intermediate second louvers 262 by ΔLH.

As is shown in FIG. 4, all of the first louvers 24 are parallel to one another and all of the second louvers 26 are also parallel to one another in the fin 14. Hence, for example, as the airflow-end louver length LLN of the upstream-end first louver 241 becomes longer, the base 44 of the upstream-end first louver 241 is displaced to the air-current upstream side and hence the inter-louver passage 28 between the upstream-end first louver 241 and the adjacent intermediate first louver 242 becomes wider. Some of the inter-louver passages 28 are widened as above in order to enhance the heat exchange performance of the radiator 10 by restricting stagnation of air at points at which an air current readily stagnates otherwise.

As is shown in FIG. 3, the fin width WDfn in the radiator 10 is as long as a longitudinal diameter Dtb of the tube 12. Hence, a width of the core portion 16 (see FIG. 1) in the airflow direction X1, namely, a core width, is as wide as the fin width WDfn.

Figure 6:
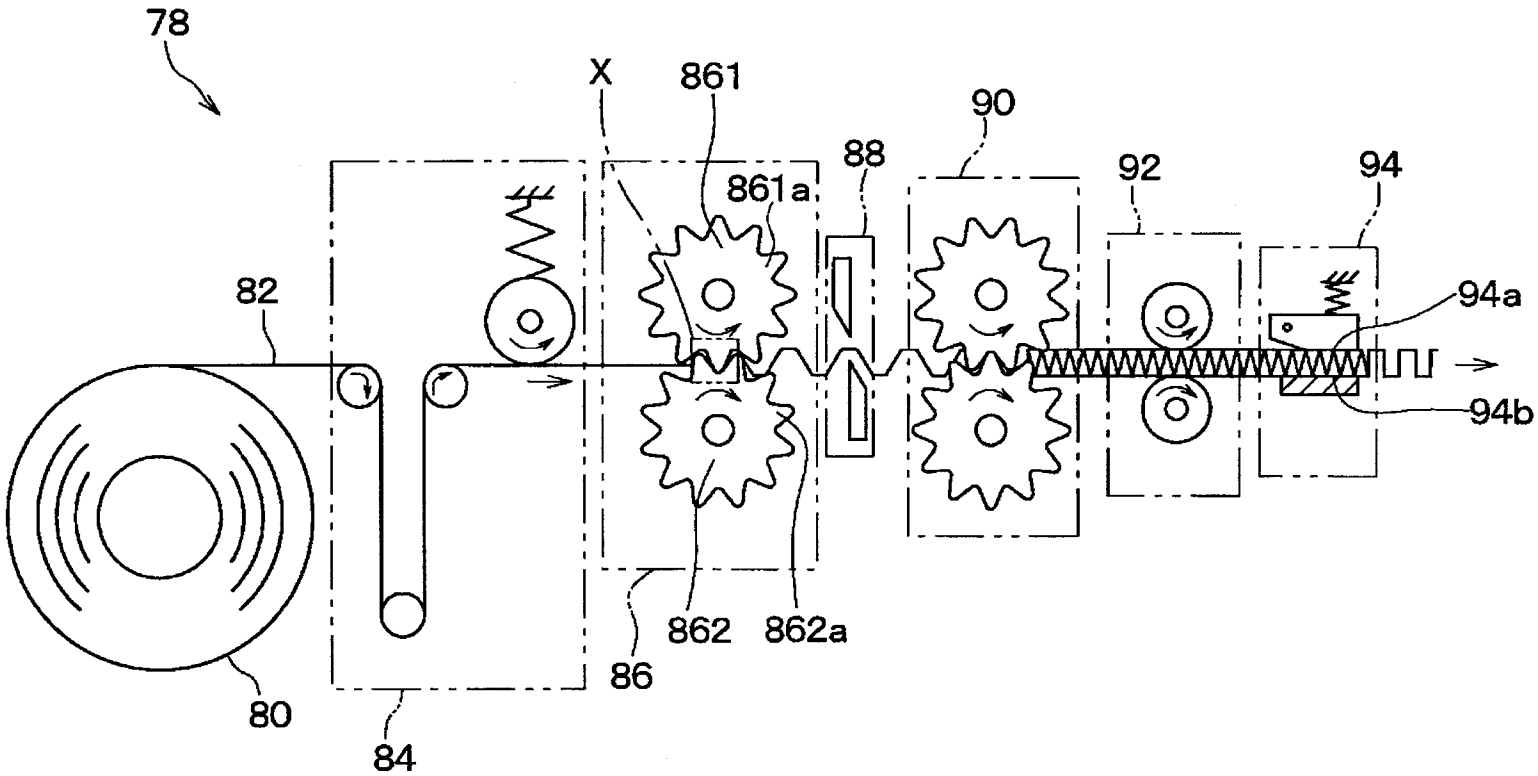
FIG. 6 is a view schematically showing a roller shaping device which is a fin manufacturing device for manufacturing of the fin of the radiator of the first embodiment.

A manufacturing method of the fin 14, namely, roller shaping will now be described briefly. FIG. 6 is a schematic view of a roller shaping device 78 which is a fin manufacturing device of the present embodiment. As is shown in FIG. 6, tension is conferred to a thin sheet of fin material 82 rolled out from an uncoiler, namely, a material roll 80 by a tension device 84 that confers predetermined tension to the fin material 82.

A fin shaping device 86 makes the fin material 82 into a corrugated shape by folding the fin material 82 to which the predetermined tension has been conferred by the tension device 84 and thereby providing a large number of the curved portions 142 (see FIG. 2) and also provides the louvers 24 and 26.

Figure 7:
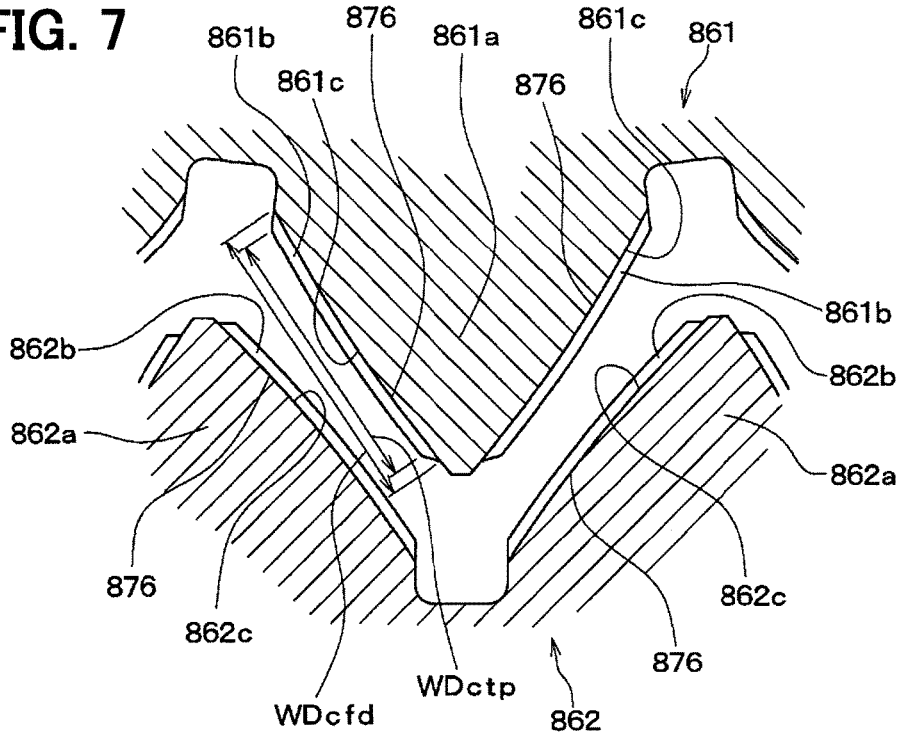
FIG. 7 is a sectional view showing a meshed portion of a pair of shaping rollers in a fin shaping device that forms a part of the roller shaping device of the first embodiment.
Figure 8:
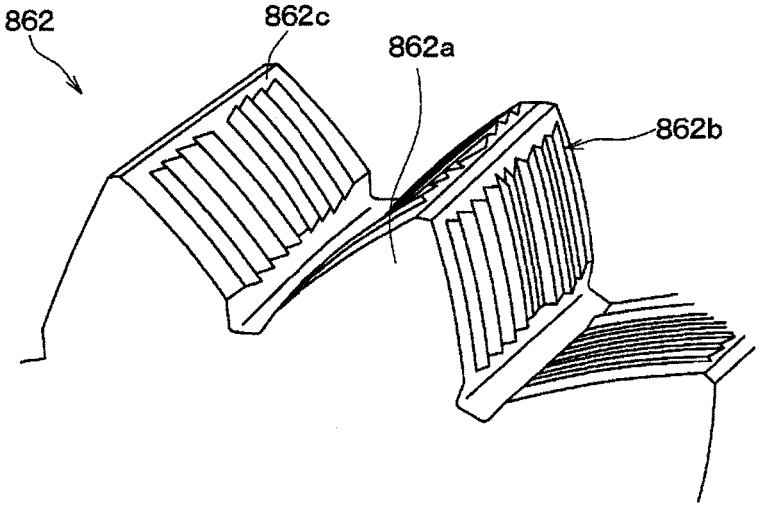
FIG. 8 is a perspective view partially showing one of the pair of shaping rollers of the first embodiment.

The fin shaping device 86 includes a pair of gear-like shaping rollers 861 and 862. The shaping rollers 861 and 862 include multiple external teeth 861*a* and 862*a*, respectively, which are aligned in a circumferential direction. As is shown in FIG. 7, tooth flanks 861*c* of each external tooth 861*a* and tooth flanks 862*c* of each external tooth 862*a* are provided, respectively, with louver-shaping cutting blades 861*b* and 862*b* to shape the louvers 24 and 26. More specifically, as is shown in FIG. 8 which is a perspective view showing a part of one of a pair of the shaping rollers 861 and 862, the multiple louver-shaping cutting blades 861*b* are provided to each tooth flank 861*c* of the external teeth 861*a* and aligned in an axial direction of the shaping roller 861, namely, a roller axial direction, and the multiple louver-shaping cutting blades 862*b* are provided to each tooth flank 862*c* of the external teeth 862*a* and aligned in an axial direction of the shaping roller 862, namely, a roller axial direction. FIG. 7 is a sectional view showing a meshed portion of a pair of the shaping rollers 861 and 862 in a disengaged state.

The fin shaping device 86 as above lets the fin material 82 be bitten by a pair of the shaping rollers 861 and 862. While the fin material 82 passes by a space between a pair of the shaping rollers 861 and 862, the fin shaping device 86 makes the fin material 82 into a corrugated shape by folding the fin material 82 so as to conform to the external teeth 861*a* and 862*a* of the shaping rollers 861 and 862, respectively, and also shapes the louvers 24 and 26 using the louver-shaping cutting blades 861*b* and 862*b*. In other words, a set of the first louver group 30 and the second louver group 32 aligned in a row as shown in FIG. 3 is shaped simultaneously by the fin shaping device 86.

A cutting device 88 shown in FIG. 6 cuts the fin material 82 in a predetermined length so as to provide one fin 14 with a predetermined number of the curved portions 142 (see FIG. 2). The fin material 82 cut in the predetermined length is sent to a correction device 92 by a feed device 90.

The correction device 92 is a correction device that corrects irregularities of the curved portions 142 by pressing the curved portions 142 in a direction substantially at right angle to a ridge direction of the curved portions 142.

A brake device 94 is a brake device having brake surfaces 94*a* and 94*b* that generate a frictional force to a direction opposite to a travel direction of the fin material 82 by coming into contact with the multiple curved portions 142. The brake device 94 uses a feed force generated by the feed device 90 and the frictional force generated by the brake surfaces 94*a* and 94*b* to compress the fin material 82 in such a manner that the curved portions 142 adjacent to each other in the feed direction of the fin material 82 are in contact with each other.

An operation of the roller shaping device 78 described above will be now be described in order of steps performed in the roller shaping device 78.

Firstly, the roller shaping device 78 performs a roll-out step of rolling out the fin material 82 from the material roll 80 and performs next a tension generation step of conferring predetermined tension to the rolled-out fin material 82 in the travel direction of the fin material 82 using the tension device 84. The roller shaping device 78 next performs a fin shaping step of shaping the curved portions 142 and the louvers 24 and 26 in the fin material 82 using the fin shaping device 86. Subsequently, in the roller shaping device 78, the roller shaping device 78 performs a fin separation step of separating the fin material 82 from the shaping rollers 861 and 862 at the center flat portion 36 in which no louvers 24 and 26 are provided and performs a cutting step of cutting the fin material 82 in the predetermined length using the cutting device 88.

Subsequently, the roller shaping device 78 performs a feeding step of feeding the fin material 82 cut in the predetermined length to the correction device 92 using the feed device 90. The roller shaping device 78 next performs a correcting step of correcting irregularities by pressing the curved portions 142 using the correction device 92 and performs a compression step of compressing the fin material 82 for the adjacent curved portions 142 to be in contact with each other using the brake device 94. The fin material 82 after the compression step stretches with an own elastic force and eventually has a predetermined fin pitch.

In the fin shaping step as above, the louvers 24 and 26 aligned in a row in the airflow direction X1 are shaped in such a manner that the louvers 24 and 26 are shaped row by row. Hence, in order to avoid unnecessary material deformation, it is preferable that the multiple louver-shaping cutting blades 861*b* and 862*b* start to cut in the fin material 82 at the same time for the louvers 24 and 26 in a row.

Figure 9:
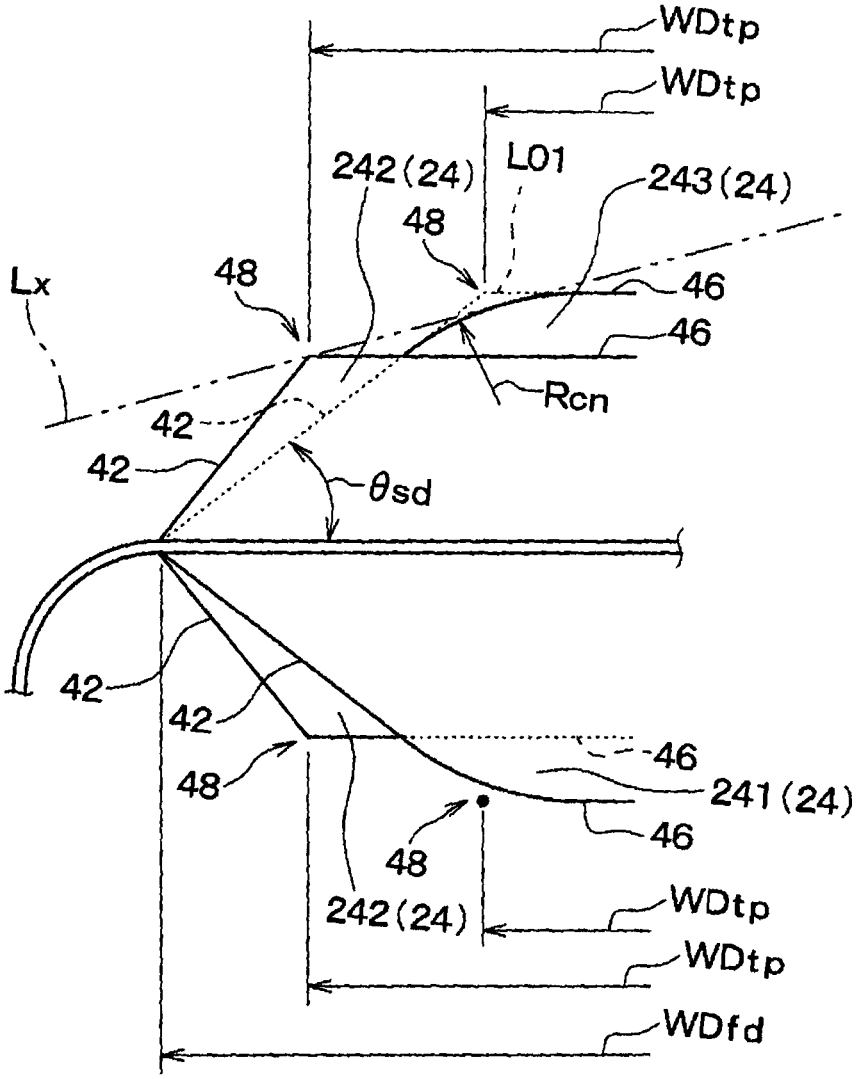
FIG. 9 is an enlarged view of a part IX in FIG. 5.

Accordingly, the louvers 24 and 26 of the present embodiment are shaped as shown in FIG. 9. FIG. 9 is an enlarged view in a part IX of FIG. 5 and shows the upstream-end first louver 241, the intermediate first louvers 242, and the downstream-end first louver 243 in a superimposed state. A description will be given in the following with reference to FIG. 9 regarding the first louvers 24. It should be appreciated, however, that the same applies to the second louvers 26.

To be more specific, as is shown in FIG. 9, when viewed in the airflow direction X1, the louver tip end widths WDtp of the upstream-end first louver 241 and the downstream-end first louver 243 are short in comparison with the intermediate first louvers 242. In other words, in the multiple louvers 24 and 26 aligned in a row in the airflow direction X1 (see FIG. 4), the louver tip end width WDtp becomes shorter as the louver height LH (see FIG. 5) becomes higher. Hence, the louver side-end angles θsd of the upstream-end first louver 241 and the downstream-end first louver 243 are small in comparison with the intermediate first louvers 242. In other words, in the multiple louvers 24 and 26 aligned in a row in the airflow direction X1, the louver side-end angle θsd becomes smaller as the louver height LH becomes higher.

Further, as is shown in FIG. 9, when viewed in the airflow direction X1, an outer shape of a tip end corner 48 of the first louver 24 at which the side end 42 intersects with the tip end 46 includes a corner R in the upstream-end first louver 241 and the downstream-end first louver 243. In other words, outer shapes of the tip end corners 48 of the upstream-end first louver 241 and the downstream-end first louver 243 are of an arc shape. On the other hand, outer shapes of the tip end corners 48 of the intermediate first louvers 242 are not of an arc shape. Hence, in the multiple louvers 24 and 26 aligned in a row in the airflow direction X1, a radius of curvature, Rcn, of the outer shape of the tip end corner 48 becomes larger as the louver height LH becomes higher.

More specifically, as is shown in FIG. 9, the tip end corners 48 on the same side of the multiple louvers 24 and 26, when viewed in the airflow direction X1, are tangent to a predetermined straight line Lx in all of the louvers 24 and 26 aligned in a row in the airflow direction X1. The straight line Lx is a virtual line corresponding to a cutting blade tip end 875 of the louver shaping cutting blade 862*b*, which is one of the louver-shaping cutting blades 861*b* and 862*b* meshed with each other in FIG. 10 described below. In other words, the tip end corners 48 on the same side of the multiple louvers 24 and 26 are positioned on a same flat plane (Lx) parallel to the airflow direction X1.

Figure 10:
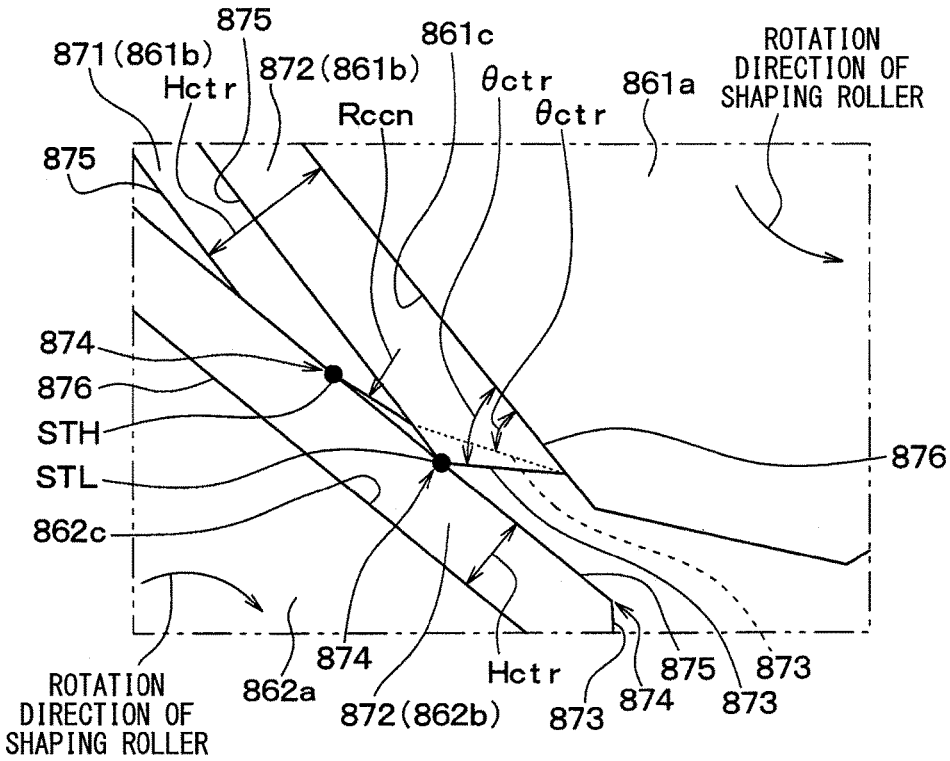
FIG. 10 is an enlarged view of a part X in FIG. 6.

FIG. 10 is an enlarged view of the external teeth 861*a* and 862*a* of the shaping rollers 861 and 862, respectively, which are meshed with each other, that is, an enlarged view in a part X of FIG. 6. As is shown in FIG. 10, cutting blade heights Hctr from the tooth flanks 861*c* and 862*c* to the cutting blade tip end 875 when viewed in the roller axial direction, that is, the cutting blade heights Hctr of the louver-shaping cutting blades 861*b* and 862*b* that cut and raise the louvers 24 and 26 are heights corresponding to the louver heights LH (see FIG. 5) of the louvers 24 and 26 to be cut and raised by the louver-shaping cutting blades 861*b* and 862*b*.

In other words, some of the multiple louver-shaping cutting blades 861*b* and 862*b* have different cutting blade heights (Hctr). For example, the cutting blade height Hctr of one of the mutually opposing louver-shaping cutting blades 861*b* and 862*b* used to cut and raise the upstream-end first louver 241 (see FIG. 4) is high in comparison with the louver-shaping cutting blades 861*b* and 862*b* used to cut and raise the intermediate first louvers 242 and the intermediate second louvers 262 (see FIG. 4). The louver-shaping cutting blades 861*b* and 862*b* have different cutting blade heights Hctr as above because the louver height LH of the upstream-end first louver 241 is high in comparison with the intermediate first louvers 242 and the intermediate second louvers 262.

The cutting blade heights Hctr of the louver-shaping cutting blades 861*b* and 862*b* used to cut and raise the downstream-end first louver 243, the upstream-end second louver 261, and the downstream-end second louver 263 (see FIG. 4) are set in the same manner as the louver-shaping cutting blades 861*b* and 862*b* used to cut and raise the upstream-end first louver 241.

When the louver-shaping cutting blades 861*b* and 862*b* are distinguished according to the cutting blade heights Hctr in the description of FIG. 10, the louver-shaping cutting blades 861*b* and 862*b* having the higher cutting blade heights Hctr are referred to as a tall louver-shaping cutting blade 871 (high cutting blade) and the louver-shaping cutting blades 861*b* and 862*b* having the lower cutting blade heights Hctr are referred to as a short louver-shaping cutting blade 872 (low cutting blade).

As is shown in FIG. 10, when viewed in the roller axial direction, widths WDctp at the cutting blade tip end 875 (see FIG. 7) of the louver-shaping cutting blades 871 and 872 are a width corresponding to the louver tip end width WDtp (see FIG. 9). In other words, the width WDctp at the cutting blade tip end 875 of the tall louver-shaping cutting blade 871 is short in comparison with the short louver-shaping cutting blade 872.

Cutting blade side ends 873 of the louver-shaping cutting blades 871 and 872 used to shape the side ends 42 of the louvers 24 and 26 (see FIG. 9) are provided at a cutting-blade side-end angle θctr corresponding to the louver side-end angle θsd (see FIG. 9). In other words, the cutting-blade side-end angle θctr of the tall louver-shaping cutting blade 871 is small in comparison with the short louver-shaping cutting blade 872. That is to say, in the respective louver-shaping cutting blades 871 and 872 of the shaping rollers 861 and 862 (see FIG. 6), respectively, which are aligned in a row in the axial direction, the cutting-blade side-end angle θctr, namely, a cutting tip angle θctr, becomes smaller as the cutting blade height Hctr becomes higher. The term, "cutting-blade side-end angle θctr" referred to herein means an angle between the cutting-blade side end 873 and the respective tooth flanks 861*c* and 862*c* when viewed in the roller axial direction.

As is shown in FIG. 10, a cutting blade tip end corner 874 of the louver-shaping cutting blades 871 and 872 used to provide the tip end corners 48 (see FIG. 9) of the louvers 24 and 26, that is, the cutting blade tip end corner 874 at which the cutting-blade side end 873 intersects with the cutting blade tip end 875, has an arc-like outer shape in the tall louver shaping blade 871. The cutting blade tip end corner 874 of the tall louver-shaping cutting blade 871 has the arc-like outer shape because the tip end corners 48 of the upstream-end first louver 241, the downstream-end first louver 243, the upstream-end second louver 261, and the downstream-end second louver 263 have an arc-like outer shape as has been described above. On the other hand, the outer shape of the cutting blade tip end corner 874 is not of an arc shape in the short louver-shaping cutting blade 872. In short, a radius of curvature, Rccn, of the outer shape is zero. As has been described, when viewed in the roller axial direction, the radius of curvature, Rccn, of the outer shape of the cutting blade tip end corner 874 is large in the tall louver-shaping cutting blade 871 in comparison with the short louver-shaping cutting blade 872.

Hence, in FIG. 10, the tall louver shaping blades 871 provided to the external tooth 861*a* of the shaping roller 861 (see FIG. 6) start to mesh with the opposing short louver-shaping cutting blades 872 at a point STH with the fin material 82 (see FIG. 6) in between. The short louver-shaping cutting blades 872 aligned in the axial direction of the shaping roller 861 for the tall louver-shaping cutting blades 871 start to mesh with the opposing short louver-shaping cutting blades 872 at a point STL with the fin material 82 in between. The points STH and STL are positioned on the cutting blade tip end 875 of one short louver-shaping cutting blade 872. Hence, a meshing start time of the tall louver-shaping cutting blades 871 at the point STH is the same as a meshing start time of the short louver-shaping cutting blades 872 at the point STL.

In other words, because the louvers 24 and 26 have the outer shapes shown in FIG. 9 as described above, the louver-shaping cutting blades 871 and 872 start to cut in the fin material 82 (see FIG. 6) at the same time for the multiple louvers 24 and 26 aligned in a row in the airflow direction X1.

As is shown in FIG. 10, when viewed in the roller axial direction, a cutting blade base width WDcfd (see FIG. 7) of a cutting blade base 876 at which the louver-shaping cutting blades 871 and 872 intersect with the tooth flanks 861*c* and 862*c* is equal in both of the tall louver-shaping cutting blade 871 and the short louver-shaping cutting blade 872. In short, the cutting blade base widths WDcfd are equal to one another in all of the louver-shaping cutting blades 871 and 872 regardless of the cutting blade heights Hctr.

As has been described, according to the present embodiment, when the louvers 24 and 26 are viewed in the airflow direction X1, the louver tip end width WDtp becomes shorter as the louver height LH (see FIG. 5) becomes higher. In other words, louvers having a high louver height LH among the multiple louvers 24 and 26 have a short louver tip end width WDtp in comparison with the louvers having a low louver height LH. Hence, in a case where the fin 14 is shaped, for example, by the roller shaping shown in FIG. 6, when the respective louver-shaping cutting blades 871 and 872 come into contact with the fin material 82, a lag in contact timing of the blades becomes smaller with one another. Consequently, the radiator 10 includes the fin 14 with restricted shape deformation unnecessary for roller shaping and therefore becomes capable of obtaining satisfactory heat exchange performance.

Figure 11:
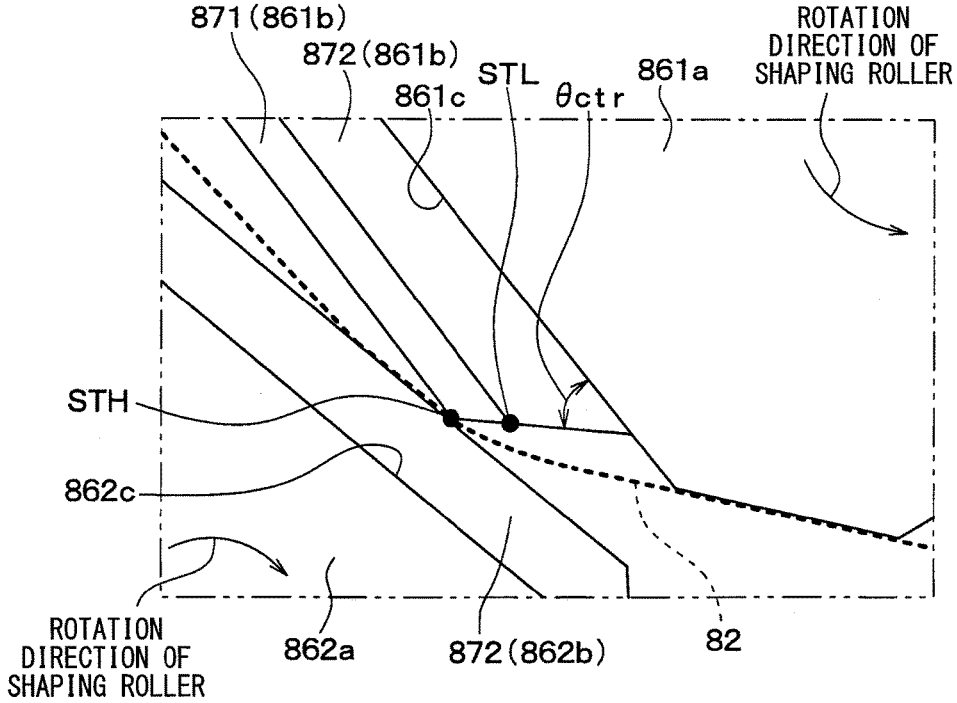
FIG. 11 is a view of a comparative example of the first embodiment in which a louver side-end angle is assumed to be equal in all louvers regardless of a louver height.

For example, assume that the louver side-end angle θsd of FIG. 9 is equal in all of the louvers 24 and 26 regardless of the louver heights LH. Then, the respective louver-shaping cutting blades 871 and 872 provided to the external teeth 861*a* and 862*a* of the shaping rollers 861 and 862, respectively, mesh with each other as shown in FIG. 11, which is a view corresponding to FIG. 10. In other words, in association with rotations of the shaping rollers 861 and 862, the tall louver shaping blades 871 start to mesh with the opposing short louver-shaping cutting blades 872 at the point STH with the fin material 82 in between first. Subsequently, with a delay from the start of the meshing at the point STH, the short louver-shaping cutting blades 872 start to mesh with the opposing short louver-shaping cutting blades 872 at the point STL with the fin material 82 in between.

When the meshing start times are different as shown in FIG. 11, the fin material 82 is pulled in by the tall shaping cutting blades 871 from the meshing start time at the point STH to the meshing start time at the point STL and the fin material 82 undergoes deformation in a direction in which the louvers 24 and 26 are aligned. In short, shape deformation unnecessary for the roller shaping occurs.

Also, for example, assume that the tip end corner 48 of the downstream-end first louver 243 shown in FIG. 9 is of a shape indicated by a broken line L01 instead of an arc shape. Then, the tip end corner 48 in the state of FIG. 9 protrudes from the straight line Lx. It is therefore necessary to make the louver tip end width WDtp shorter by further reducing the louver side-end angle θsd of the downstream-end first louver 243 of FIG. 9. In other words, in the present embodiment, the radius of curvature, Rcn, of the outer shape of the tip end corner 48 in the louvers 24 and 26 becomes larger as the louver height LH becomes higher as shown in FIG. 9. Hence, it is not necessary to make the louver tip end width WDtp noticeably short in comparison with a case where the radius of curvature, Rcn does not become larger as the louver height LH becomes higher. Consequently, deterioration in heat exchange performance of the fin 14 caused by making the louver tip end width WDtp shorter can be restricted.

According to the present embodiment, in the fin shaping step by the fin shaping device 86 of FIG. 6, the multiple louver-shaping cutting blades 861*b* and 862*b* start to cut in the fin material 82 at the same timing with each other as shown in FIG. 10. The louver-shaping cutting blades 861*b* and 862*b* therefore mutually cancel out the pulling-in of the fin material 82 that occurs when the louver-shaping cutting blades 861*b* and 862*b* cut in the fin material 82. Hence, the present embodiment has an advantage that the fin material 82 hardly undergoes deformation in the direction in which the louver-shaping cutting blades 861*b* and 862*b* are aligned.

According to the present embodiment, some of the multiple louver-shaping cutting blades 861*b* and 862*b* of the shaping rollers 861 and 862, respectively, used in the fin shaping step have different cutting blade heights Hctr, and the width WDctp at the cutting blade tip end 875 is short in either the multiple louver-shaping cutting blade 861*b* or 862*b* whichever has the higher cutting blade height Hctr in comparison with the other having the lower cutting blade height Hctr. Hence, the fin 14 including the louvers 24 and 26 which have different louver heights LH can be shaped. Also, as is shown in FIG. 10, the multiple louver-shaping cutting blades 861*b* and 862*b* are capable of starting to cut in the fin material 82 at the same timing with each other when shaping the louvers 24 and 26.

Figure 12:
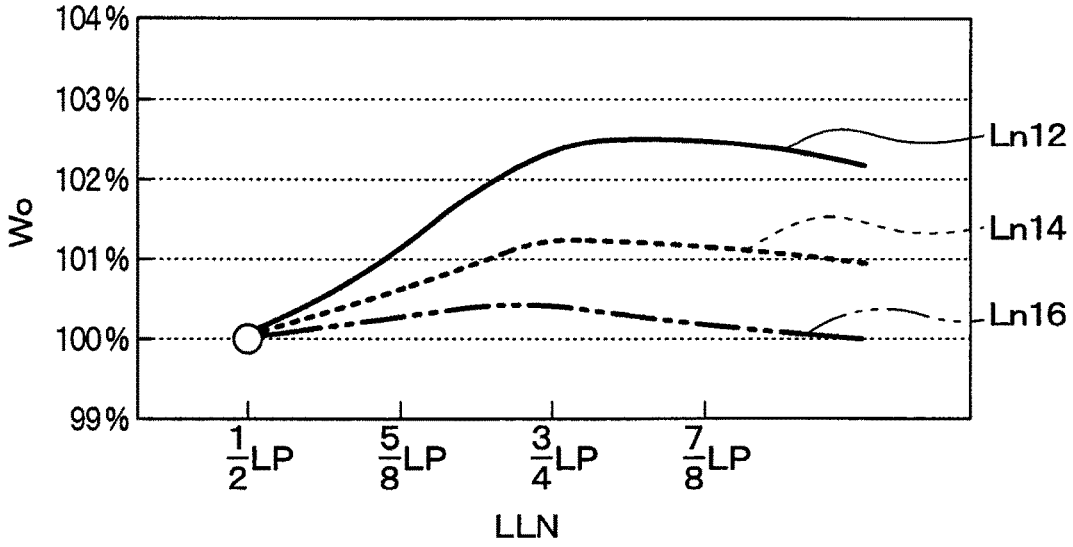
FIG. 12 is a view showing a relation of an airflow-end louver length and a radiation amount of the radiator of the first embodiment.
Figure 13:
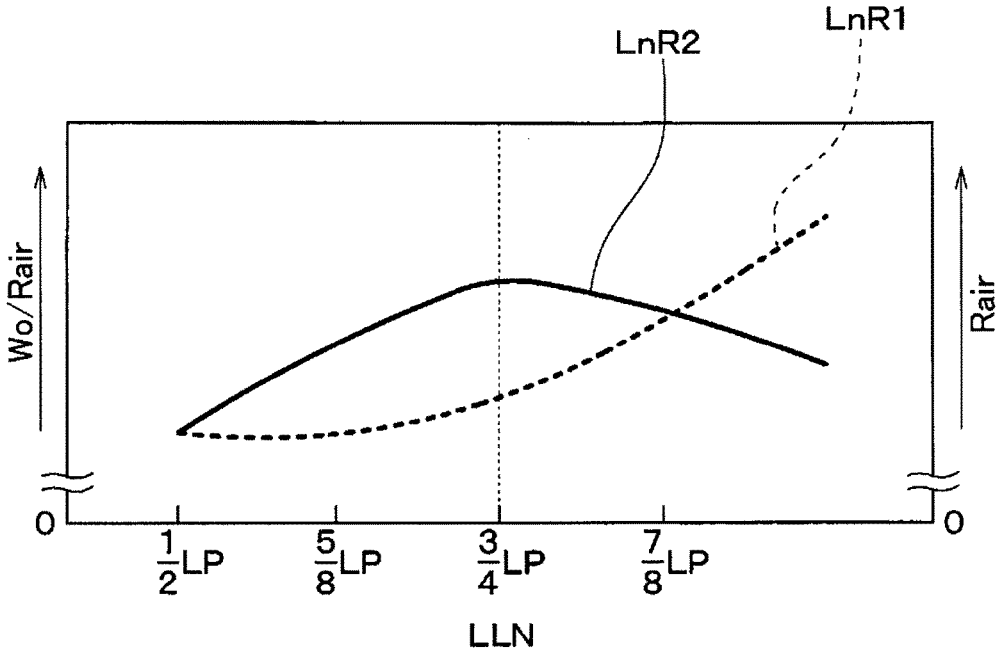
FIG. 13 is a view showing a relation of the airflow-end louver length and ventilation resistance of air passing through the radiator and also a relation of a value found by dividing the radiation amount by the ventilation resistance and the airflow-end louver length in the first embodiment.

An appropriate length of the airflow-end louver length LLN will now be described using FIG. 12 and FIG. 13. FIG. 12 and FIG. 13 show test results when the radiator 10 was supplied with a coolant at a constant temperature and a constant flow rate while air was blown into the radiator 10 at a constant temperature and a constant flow rate in the airflow direction X1. In both of FIG. 12 and FIG. 13, the airflow-end louver length LLN is expressed as a percentage in relation to the louver pitch LP (see FIG. 4). To be more specific, the louver pitch LP is 0.6 mm. The airflow-end louver lengths LLN in FIG. 12 and FIG. 13 are the airflow-end louver lengths LLN at all of the four points specified in FIG. 4.

FIG. 12 shows a relation of the airflow-end louver length LLN and a radiation amount Wo of the radiator 10. FIG. 12 shows a relation of the airflow-end louver length LLN and the radiation amount Wo for each fin width WDfn of the fin 14 (see FIG. 4). More specifically, a relation when the fin width WDfn is 12 mm is indicated by a solid line Ln12, a relation when the fin width WDfn is 14 mm is indicated by a broken line Ln14, and a relation when the fin width WDfn is 16 mm is indicated by an alternate long and two short dashes line Ln16. For example, the radiation amount Wo of the radiator 10 is calculated on the basis of a flow rate of the coolant supplied to the radiator 10 and a temperature difference between the coolant temperature at the inlet pipe 18*c* and the coolant temperature at the outlet pipe 18*d*. The unit of the radiation amount Wo is, for example, "kW" and the ordinate of FIG. 12 used for the radiation amount Wo expresses the radiation amount Wo as a percentage by setting the radiation amount Wo when the airflow-end louver length LLN is "½×LP" to 100%.

FIG. 13 shows a relation of the airflow-end louver length LLN and ventilation resistance Rair of air passing through the radiator 10 and also shows a relation of a value found by dividing the radiation amount Wo by the ventilation resistance Rair, namely, "Wo/Rair", and the airflow-end louver length LLN. More specifically, a relation of the airflow-end louver length LLN and the ventilation resistance Rair is indicated by a broken line LnR1 and the relation of a value found by dividing the radiation amount Wo by the ventilation resistance Rair and the airflow-end louver length LLN is indicated by a solid line LnR2.

In the test shown in FIG. 13, the fin width WDfn is 12 mm. Accordingly, the radiation amount Wo used to calculate a value by dividing the radiation amount Wo by the ventilation resistance Rair is the radiation amount Wo to draw the solid line Ln12 of FIG. 12. The unit of the ventilation resistance Rair is, for example, "Pa".

As is shown in FIG. 12, when the fin width WDfn is 16 mm, the radiation amount Wo of the radiator 10 varies little by changing the airflow-end louver length LLN to "½×LP" or longer. On the other hand, when the fin width WDfn is 14 mm, the radiation amount Wo of the radiator 10 peaks when the airflow-end louver length LLN is "¾×LP" and decreases little even when the airflow-end louver length LLN is in a range of "¾×LP" or longer. For example, the radiation amount Wo of the radiator 10 exceeds 101% when the airflow-end louver length LLN is "¾×LP".

When the fin width WDfn is 12 mm, an increase of the radiation amount Wo by making the airflow-end louver length LLN longer is further noticeable in comparison with the case when the fin width WDfn is 14 mm. The radiation amount Wo continues to peak when the airflow-end louver length LLN is in a range of "¾×LP" to "⅞×LP".

From the test result of FIG. 12, it is considered that making the airflow-end louver length LLN longer than "½×LP" is effective in enhancing the radiation performance of the radiator 10 when the fin width WDfn is 14 mm or shorter and further when the fin width WDfn is 12 mm or shorter. When the fin width WDfn is 14 mm or shorter, the radiation amount Wo increases obviously with the airflow-end louver length LLN set to "⅝×LP" or longer in comparison with the airflow-end louver length LLN set to "½×LP". It is therefore considered preferable to set the airflow-end louver length LLN to "⅝×LP" or longer. Also, from the solid line Ln12 and the broken line Ln14 of FIG. 12, it is considered more preferable to set the airflow-end louver length LLN to "¾×LP" or longer.

As is indicated by the broken line LnR1 of FIG. 13, the ventilation resistance Rair of the radiator 10 becomes larger in an exponential manner as the airflow-end louver length LLN becomes longer. Hence, as is indicated by the solid line LnR2 of FIG. 13, a value found by dividing the radiation amount Wo by the ventilation resistance Rair varies with a variance of the airflow-end louver length LLN in the shape of an inverted V. More specifically, the value reaches the maximum when the airflow-end louver length LLN is "¾×LP". In order to enhance the heat radiation performance of the radiator 10, it is necessary not only to increase the radiation amount Wo but also to decrease the ventilation resistance Rair. Hence, in order to increase the radiation amount Wo and decrease the ventilation resistance Rair, it is considered preferable from the solid line LnR2 of FIG. 13 to set the airflow-end louver length LLN to "⅝×LP" or longer or "¾×LP" or longer and "⅞×LP" or shorter.

The characteristics indicated by the solid line LnR2 of FIG. 13 are the characteristic when the fin width WDfn is 12 mm. However, from the solid line Ln12 and the broken line Ln14 of FIG. 12, it is considered that characteristics same as the characteristics indicated by the solid line LnR2 of FIG. 13 can be obtained even when the fin width WDfn is 14 mm. In other words, when the fin width WDfn is 14 mm or shorter, as has been described above, it is considered preferable to set the airflow-end louver length LLN to "⅝×LP" or longer or "¾×LP" or longer and "⅞×LP" or shorter.

Figure 14:
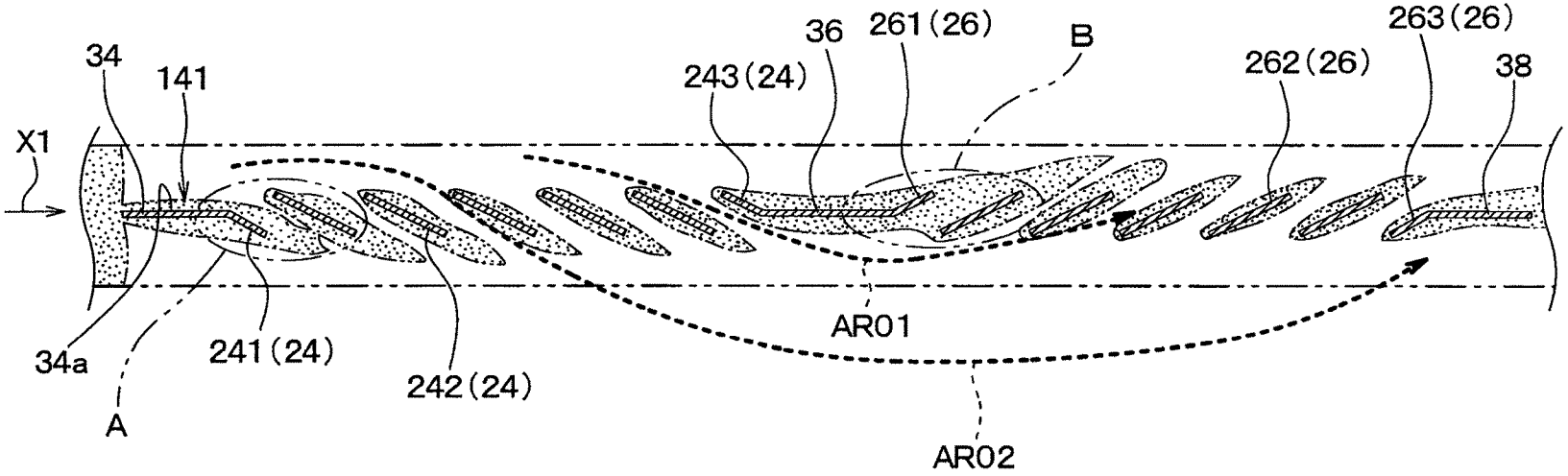
FIG. 14 is a view showing a wind velocity distribution in a ventilation simulation run on the fin of the first embodiment.

It is considered that the test results as above are obtained because the respective inter-louver passages 28 become narrower as the fin width WDfn becomes narrower and an air current readily stagnates around the louvers 24 and 26 of the fin 14. For example, as is shown in a wind velocity distribution chart of FIG. 14, stagnation of an air current occurs noticeably in a part A in the vicinity of the upstream-end first louver 241 and a part B in the vicinity of the upstream-end second louver 261. FIG. 14 shows a wind velocity distribution in a ventilation simulation run on the fin 14 having the fin width WDfn of 12 mm and the airflow-end louver length LLN of "½×LP" at all of the four points. Stagnant regions where the air current stagnates are hatched in FIG. 14.

It is considered that air flows around the louvers 24 and 26 of the fin 14 as indicated by broken arrows AR01 and AR02 due to stagnation of the air current in the part A and the part B. In other words, it is ideal for air that flows in the airflow direction X1 in FIG. 14 to be introduced by the first louvers 24 from the side of the one plane 34*a* of the upstream flat portion 34, that is, from the upper side of FIG. 14 to the opposite side, that is, the lower side of FIG. 14 to pass by the center flat portion 36, and to be introduced subsequently by the second louvers 26 from the lower side to the upper side of FIG. 14. It is, however, considered that the air flows as indicated by the broken arrow AR02 and is not fully returned from the lower side to the upper side of FIG. 14. The air flowing as indicated by the broken arrow AR02 can be a cause to deteriorate the radiation performance of the radiator 10.

On the contrary, as can be led from the test results of FIG. 12 and FIG. 13, it is considered that the stagnant regions indicated as the part A and the part B of FIG. 14 are reduced by setting the airflow-end louver length LLN to be longer than "½×LP", for example, to "⅝×LP" or longer. Consequently, it is considered that air flows around the louvers 24 and 26 as indicated by broken arrows AR03 and AR04 of FIG. 4. In other words, it is considered that air introduced by the first louvers 24 from the side of the one plane 34*a* of the upstream flat portion 34 to the opposite side is readily returned to the side of the one plane 34*a* of the upstream flat portion 34 by the second louvers 26.

As has been described, the fin width WDfn of the fin 14 is 14 mm or shorter in the present embodiment. It is preferable to set the airflow-end louver length LLN to "⅝×LP" or longer, where LP is the louver pitch in the upstream-end first louver 241, the downstream-end first louver 243, the upstream-end second louver 261, and the downstream-end second louver 263. When configured as above, it is considered that air hardly stagnates in a space between the upstream-end first louver 241 and the adjacent intermediate first louver 242, namely, the part A of FIG. 14 and a space between the upstream-end second louver 261 and the adjacent intermediate second louver 262, namely, the part B of FIG. 14. Hence, a total air volume of air passing through a space between every pair of the adjacent louvers 24 and the adjacent louvers 26 increases. Consequently, as can be understood from the test results of FIG. 12 and FIG. 13, the radiator 10 becomes capable of obtaining satisfactory heat exchange performance while reducing the fin width WDfn to 14 mm or shorter.

In the present embodiment, as is shown in FIG. 4, the upstream-end first louver 241, the downstream-end first louver 243, the upstream-end second louver 261, and the downstream-end second louver 263 are provided so as to have the airflow-end louver lengths LLN that are equal to one another. Hence, the planar portion 141 of the fin 14 in FIG. 4 can be formed in a symmetrical shape with the center flat portion 36 in between. Consequently, deformation unnecessary for manufacturing of the fin 14, for example, by the roller shaping, can be restricted.

In the present embodiment, the multiple first louvers 24 are provided to be parallel to one another and the multiple second louvers 26 are also provided to be parallel to one another. Hence, the ventilation resistance Rair of air in the respective inter-louver passages 28 can be restricted to be low in comparison, for example, with a case where neither the louvers 24 nor the louvers 26 are parallel to one another.

Second Embodiment

A second embodiment of the present disclosure will now be described. The present embodiment will chiefly describe a difference from the first embodiment described above. Portions same as or equivalent to the counterparts of the first embodiment above are not described repetitively or described briefly.

Figure 15:
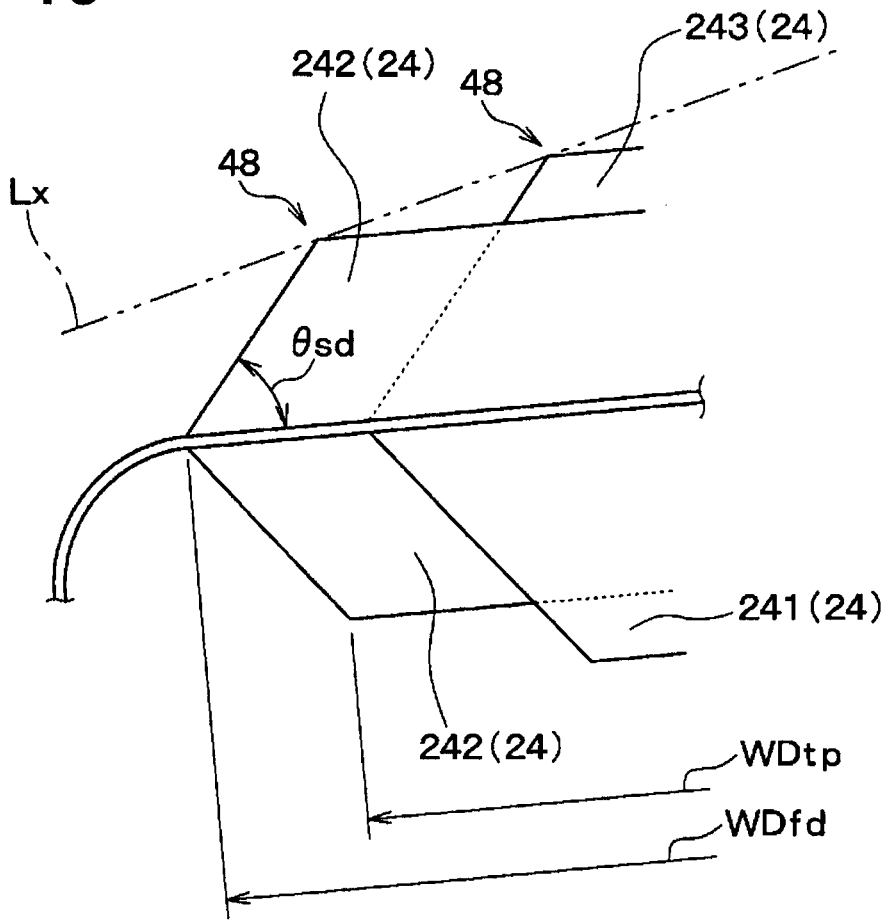
FIG. 15 is a view showing a part of a fin according to a second embodiment of the present disclosure.

FIG. 15 is a view corresponding to FIG. 9 of the first embodiment above, that is, an enlarged view in the part IX of FIG. 5 in the present embodiment. In the first embodiment above, the louver side-end angle θsd varies with the louver height LH, which is different in the present embodiment. In other words, as is shown in FIG. 15, louver side-end angles θsd are equal to one another in all of louvers 24 and 26 regardless of a louver height LH.

Hence, as is shown in FIG. 15, when viewed in an airflow direction X1, louver base widths WDfd of an upstream-end first louver 241 and a downstream-end first louver 243 are short in comparison with intermediate first louvers 242. The same applies to the second louvers 26. In other words, in the multiple louvers 24 and 26 aligned in a row in the airflow direction X1, the louver base width WDfd becomes shorter as the louver height LH (see FIG. 5) becomes higher. Other than the difference described above, the present embodiment is the same as the first embodiment above.

In the present embodiment, too, a louver tip end width WDtp becomes shorter as the louver height LH (see FIG. 5) becomes higher when the louvers 24 and 26 are viewed in the airflow direction X1 as in the first embodiment above. Hence, when a fin 14 is manufactured by roller shaping, unnecessary shape deformation of the fin 14 can be restricted.

In FIG. 15, the louver side-end angles θsd are equal to one another regardless of the louver heights LH. The louver base width WDfd therefore becomes narrower as the louver height LH (see FIG. 5) becomes higher. On the contrary, in FIG. 9 of the first embodiment above, the louver side-end angle θsd becomes smaller as the louver height LH becomes higher when the louvers 24 and 26 are viewed in the airflow direction X1. In other words, by making the louver side-end angle θsd smaller as the louver height LH becomes higher as in the first embodiment above, it is not necessary to make the louver base width WDfd shorter as in FIG. 15. In short, it is not necessary to make an inter-louver passages 28 (see FIG. 4) shorter according to the louver base widths WDfd. Hence, an increase of the ventilation resistance of air passing the inter-louver passages 28 can be restricted in the first embodiment above in comparison with the present embodiment.

Third Embodiment

A third embodiment of the present disclosure will now be described. The present embodiment will chiefly describe a difference from the first embodiment described above. Portions same as or equivalent to the counterparts of the first embodiment above are not described repetitively or described briefly. The same applies to fourth and subsequent embodiments below.

Figure 16:
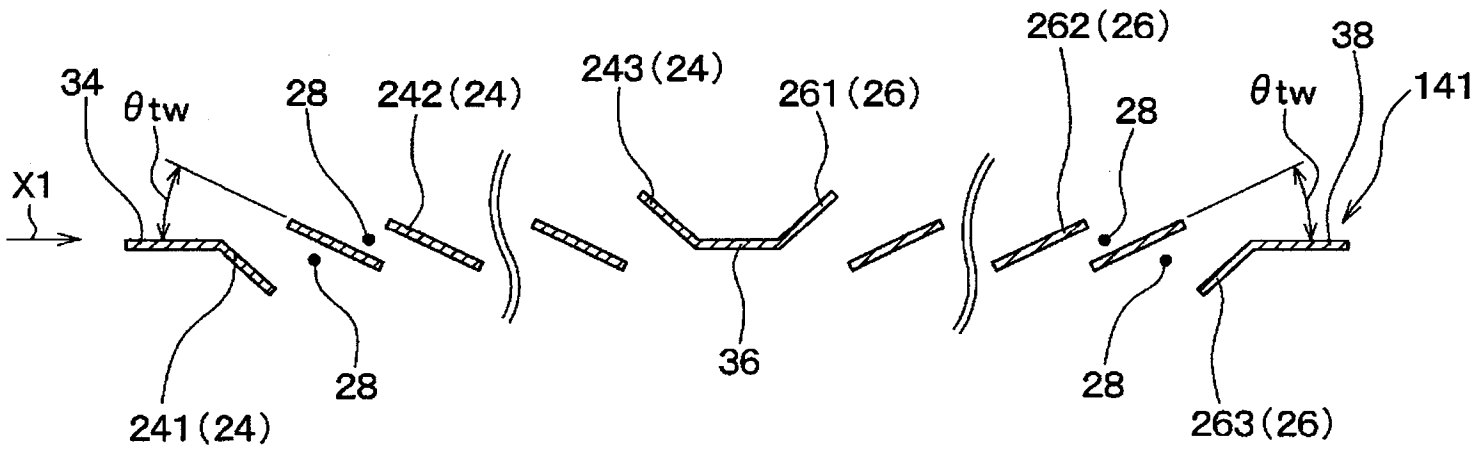
FIG. 16 is a sectional view of a fin according to a third embodiment of the present disclosure.

FIG. 16 corresponds to FIG. 4 of the first embodiment above and is a sectional view of a planar portion 141 and louvers 24 and 26 of a fin 14 when viewed in a direction same as the direction of FIG. 4. In the first embodiment above, all of the first louvers 24 are parallel to one another and all of the second louvers 26 are also parallel to one another, which is different in the present embodiment.

To be more specific, as is shown in FIG. 16, an upstream-end first louver 241 and a downstream-end first louver 243 are provided so as to have a large inclination angle with respect to an airflow direction X1, namely, a large twist angle θtw in comparison with intermediate first louvers 242. Likewise, an upstream-end second louver 261 and a downstream-end second louver 263 are provided so as to have a large twist angle θtw in comparison with intermediate second louvers 262.

In the present embodiment, too, the multiple intermediate first louvers 242 are parallel to one another and the multiple intermediate second louvers 262 are also parallel to one another as in the first embodiment above. A twist direction of the intermediate first louvers 242 is opposite to a twist direction of the intermediate second louvers 262 and the twist angle θtw of the intermediate first louvers 242 is as large as the twist angle θtw of the intermediate second louvers 262.

According to the present embodiment, the twist angles θtw of the upstream-end first louver 241, the downstream-end first louver 243, the upstream-end second louver 261, and the downstream-end second louver 263 are larger than the twist angles θtw of the other louvers 242 and 262. Hence, inter-louver passages 28 tangent to the upstream-end first louver 241, the downstream-end first louver 243, the upstream-end second louver 261, and the downstream-end second louver 263 become wider. Consequently, air hardly stagnates at the wider inter-louver passages 28 and radiation performance of a radiator 10 can be enhanced.

Fourth Embodiment

A fourth embodiment of the present disclosure will now be described. The present embodiment will chiefly describe a difference from the first embodiment described above.

Figure 17:
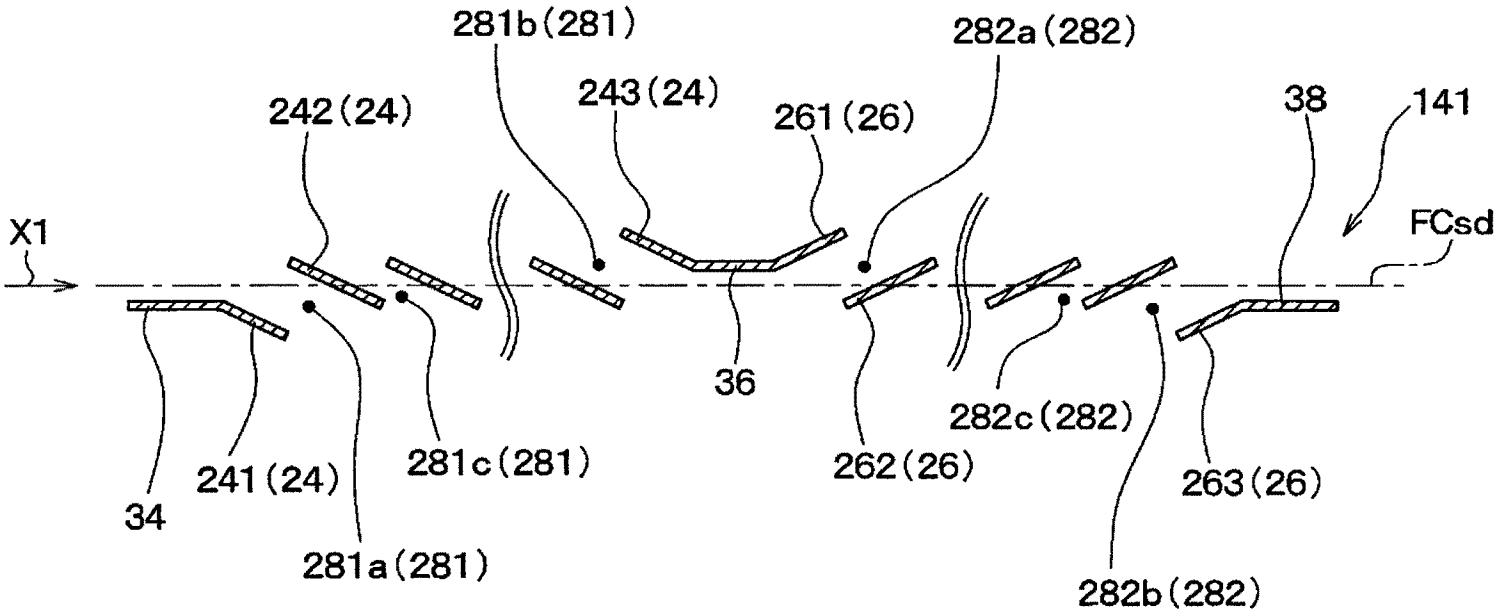
FIG. 17 is a sectional view of a fin according to a fourth embodiment of the present disclosure.

FIG. 17 corresponds to FIG. 4 of the first embodiment above and is a sectional view of a planar portion 141 and louvers 24 and 26 of a fin 14 when viewed in a direction same as the direction of FIG. 4. In the first embodiment above, air passages provided between every pair of adjacent first louvers 24 and every pair of adjacent second louvers 26 are referred to simply as inter-louver passages 28. In the present embodiment, however, the inter-louver passages 28 are classified further and referred to differently. To be more specific, air passages provided between every pair of the adjacent first louvers 24 are referred to as first inter-louver passages 281 and air passages provided between every pair of the adjacent second louvers 26 are referred to as second inter-louver passages 282.

Further, of the multiple first inter-louver passages 281, the one located uppermost stream in an air current is referred to as an uppermost-stream first inter-louver passage 281*a* and the one located lowermost stream in the air current is referred to as a lowermost-stream first inter-louver passage 281*b*. The first inter-louver passages 281 other than the uppermost-stream first inter-louver passage 281*a* and the lowermost-stream first inter-louver passage 281*b* are referred to as intermediate first inter-louver passages 281*c*.

Also, of the multiple second inter-louver passages 282, the one located uppermost stream in an air current is referred to as an uppermost-stream second inter-louver passage 282*a* and the one located lowermost stream in the air current is referred to as a lowermost-stream second inter-louver passage 282*b*. The second inter-louver passages 282 other than the uppermost-stream second inter-louver passage 282*a* and the lowermost-stream second inter-louver passage 282*b* are referred to as intermediate second inter-louver passages 282*c*.

As is shown in FIG. 17, a center flat portion 36 is offset to one side with respect to a reference level FCsd indicating a thickness center of connection portions 40 (see FIG. 3 and FIG. 18), namely, an alternate long and short dash line of FIG. 17. Also, an upstream flat portion 34 and a downstream flat portion 38 are offset to the other side with respect to the reference level FCsd.

Figure 18:
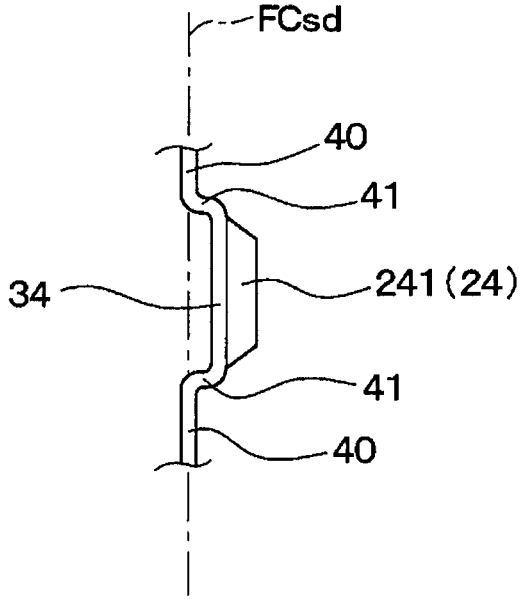
FIG. 18 is a side view of the fin of the fourth embodiment.

As is shown in FIG. 18 which is a side view of the planar portion 141 and the louvers 24 and 26 of FIG. 17 when viewed from upstream in the air current, for example, the upstream flat portion 34 is connected to a pair of the connection portions 40 with mediate portions 41 interposed between the upstream flat portion 34 and the respective connection portions 40. The mediate portions 41 are provided integrally with the upstream flat portion 34 and the connection portions 40. As with the upstream flat portion 34 shown in FIG. 18, each of the center flat portion 36 and the downstream flat portion 38 is also connected to a pair of the connection portions 40 with the mediate portions 41.

As has been described, the upstream flat portion 34, the center flat portion 36, and the downstream flat portion 38 are disposed to be separately displaced with respect to the connection portions 40 in the thickness direction of the connection portions 40. Accordingly, of the multiple first inter-louver passages 281, the uppermost-stream first inter-louver passage 281*a* and the lowermost-stream first inter-louver passage 281*b* become wider than the other first inter-louver passages 281, namely, the intermediate first inter-louver passages 281*c*. Also, of the multiple second inter-louver passages 282, the uppermost-stream second inter-louver passage 282*a* and the lowermost-stream second inter-louver passage 282*b* become wider than the other second inter-louver passages 282, namely, the intermediate second inter-louver passages 282*c*.

Hence, according to the present embodiment, an air current hardly stagnates in the uppermost-stream first inter-louver passage 281*a*, the lowermost-stream first inter-louver passage 281*b*, the uppermost-stream second inter-louver passage 282*a*, and the lowermost-stream second inter-louver passage 282*b*. Consequently, radiation performance of a radiator 10 can be enhanced.

Fifth Embodiment

A fifth embodiment of the present disclosure will now be described. The present embodiment will chiefly describe a difference from the first embodiment described above.

Figure 19:
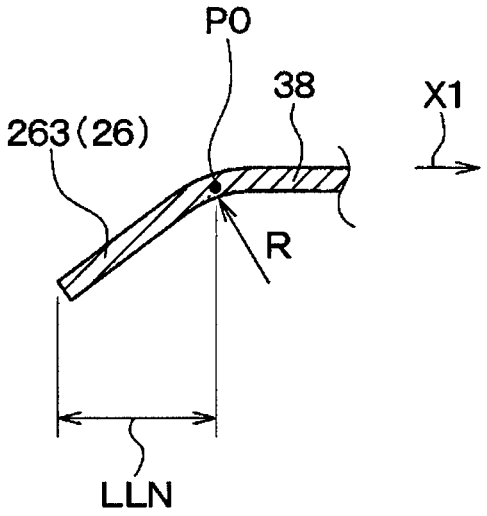
FIG. 19 is a view showing a shape of a part of a fin according to a fifth embodiment of the present disclosure, which part corresponding to a part XXII of FIG. 4 of the first embodiment.

FIG. 19 is a view corresponding to an enlarged view in a part XXII of FIG. 4 of the first embodiment above and shows a difference of the present embodiment from the first embodiment above. As is shown in FIG. 19, a coupling portion of a downstream-end second louver 263 and a downstream flat portion 38 is provided by a corner R. In short, the coupling portion is of a curved shape.

As with the coupling portion of the downstream-end second louver 263 and the downstream flat portion 38 shown in FIG. 19, a coupling portion of an upstream-end first louver 241 and an upstream flat portion 34, a coupling portion of a downstream-end first louver 243 and a center flat portion 36, and a coupling portion of an upstream-end second louver 261 and the center flat portion 36 are also of a curved shape.

In the present embodiment, as is shown in FIG. 19, an airflow-end louver length LLN of the downstream-end second louver 263 is determined in reference to a base point, which is a connection point PO of the downstream-end second louver 263 and the downstream flat portion 38 found on the assumption that the coupling portion has no curved shape. The same applies to the airflow-end louver lengths LLN of the upstream-end first louver 241, the downstream-end first louver 243, and the upstream-end second louver 261.

As has been described, according to the present embodiment configured as above, air introduced to each of the upstream-end first louver 241, the downstream-end first louver 243, the upstream-end second louver 261, and the downstream-end second louver 263 change a flow direction smoothly in the respective coupling portions of a curved shape as described above along the curved shape. Hence, an air current hardly stagnates in the vicinity of the upstream-end first louver 241, the downstream-end first louver 243, the upstream-end second louver 261, and the downstream-end second louver 263. Consequently, radiation performance of a radiator 10 can be enhanced.

(1) In the embodiments described above, the multiple louvers 24 and 26 have louver heights LH that differ in two steps: the higher side and the lower side. However, the louver heights may differ in three or more steps. Even in a case where the louver heights LH differ in three or more steps, as is shown in FIG. 9, it is preferable that the tip end corners 48 of the louvers 24 and 26 are tangent to the one straight line Lx of FIG. 9 in all of the louvers 24 and 26 aligned in a row in the airflow direction X1.

(2) In the embodiments described above, the louver height LH is higher in the upstream-end first louver 241, the downstream-end first louver 243, the upstream-end second louver 261, and the downstream-end second louver 263 than in the other louvers 242 and 262. However, a high louver height LH may be set in any one of the multiple louvers 24 and 26 aligned in a row in the airflow direction X1.

(3) In the embodiments described above, as is shown in FIG. 4, the upstream-end first louver 241 and the downstream-end first louver 243 are provided so as to be parallel to the intermediate first louvers 242. However, for example, the twist angles θtw of the upstream-end first louver 241 and the downstream-end first louver 243 may be large in comparison with the intermediate first louvers 242. Likewise, the twist angles θtw of the upstream-end second louver 261 and the downstream-end second louver 263 may be large in comparison with the intermediate second louvers 262. When the first louvers 24 and the second louvers 26 include the louvers 24 and 26 having different twist angles θtw as above, the louvers 24 and 26 having the different twist angles θtw have different louver heights LH.

(4) In the embodiments described above, the fin width WDfn is as long as the longitudinal diameter Dtb of the tubes 12. However, the former and the latter may be different from each other.

(5) In the embodiments described above, the fin 14 is a corrugated fin. However, other types of fin may be used as long as the fin can be formed by roller shaping.

(6) In the embodiments described above, the fin 14 is bonded to the tubes 12 by, for example, brazing. However, the fin 14 may be bonded to the tubes 12 using other bonding methods.

(7) In the embodiments described above, the first fluid flowing the tubes 12 is a coolant. However, the first fluid may be a liquid other than the coolant or a gas.

(8) In the embodiments described above, the second fluid flowing around the tubes 12 is air. However, the second fluid may be a gas other than air or a liquid.

(9) In the first embodiment described above, the corner R is provided to the outer shapes of the tip end corners 48 of the upstream-end first louver 241, the downstream-end first louver 243, the upstream-end second louver 261, and the downstream-end second louver 263. The corner R, however, may not be provided. When the corner R is absent, the louver side-end angle θsd shown in FIG. 5 may be reduced instead.

(10) In the first embodiment described above, the corner R is not provided to the outer shapes of the tip end corners 48 of the intermediate first louvers 242 and the intermediate second louvers 262. However, the corner R may be provided. In such a case, it is preferable that the radius of curvature, Rcn, of the corner R provided to the tip end corners 48 of the intermediate first louvers 242 and the intermediate second louvers 262 is small in comparison with the upstream-end first louver 241, the downstream-end first louver 243, the upstream-end second louver 261, and the downstream-end second louver 263.

(11) In the second embodiment described above, the corner R as shown in FIG. 19 is not provided to the outer shapes of the tip end corners 48 of the upstream-end first louver 241, the downstream-end first louver 243, the upstream-end second louver 261, and the downstream-end second louver 263. However, the corner R may be provided.

(12) In the first embodiment described above, the airflow-end louver lengths LLN (see FIG. 4) of the upstream-end first louver 241, the downstream-end first louver 243, the upstream-end second louver 261, and the downstream-end second louver 263 are equal to one another. However, the airflow-end louver lengths LLN may be different in some of the foregoing louvers. For example, from the wind velocity distribution chart of FIG. 14, air readily stagnates in the part A and the part B. In other words, air readily stagnates in the vicinity of the upstream-end first louver 241 and in the vicinity of the upstream-end second louver 261. Hence, the airflow-end louver lengths LLN of the upstream-end first louver 241 and the upstream-end second louver 261 may be set to "⅝×LP" or longer while setting the airflow-end louver lengths LLN of the downstream-end first louver 243 and the downstream-end second louver 263 to "½×LP".

(13) In the embodiments described above, the fin 14 is a corrugated fin. However, the fin 14 may be a sheet-like plate fin which is not formed in a corrugated shape.

(14) In the first embodiment described above, the fin 14 having the louver pitch LP of 0.6 mm is used in the tests shown in FIG. 12 and FIG. 13. However, the fin 14 of FIG. 1 may include the louvers 24 and 26 at a louver pitch LP of other than 0.6 mm.

It should be appreciated that the present disclosure is not limited to the embodiments described above and can be modified appropriately within the scope of the present disclosure. The embodiments described above are not irrelevant to one another and can be combined appropriately unless a combination is obviously impossible. In the respective embodiments described above, it goes without saying that elements forming the embodiments are not necessarily essential unless specified as being essential or deemed as being apparently essential in principle. In a case where a reference is made to the components of the respective embodiments as to numerical values, such as the number, values, amounts, and ranges, the components are not limited to the numerical values unless specified as being essential or apparently limited to the numerical values in principle. Also, in a case where a reference is made to the components of the respective embodiments above as to materials, shapes, and positional relations, the components are not limited to the materials, the shapes, and the positional relations unless explicitly specified or limited to particular materials, shapes and positional relations in principle.

What is claimed is:

1. A heat exchanger, comprising:

tubes through which a first fluid flows; and a fin bonded to the tubes to promote heat exchange between the first fluid and a second fluid that flows along one direction through spaces among the tubes, wherein the fin includes a planar portion having a plate-like shape along the one direction, and louvers aligned in the one direction on the planar portion and inclined with respect to the planar portion, the louvers include a higher louver and a lower louver that is lower than the higher louver in a louver height from the planar portion to a tip end of the louver, the higher louver is shorter than the lower louver in a length at the tip end along the planar portion, each of the louvers has tip end corners, at which the tip end intersects with a side end, on both sides of each of the louvers, the tip end corners located on a same side of the louvers are positioned on a same flat plane parallel to the one direction, and the higher louver is larger than the lower louver in a radius of curvature of outer shapes of the tip end corners.

2. The heat exchanger according to claim 1, wherein the higher louver is smaller than the lower louver in a louver side-end angle between the side end and the planar portion.

3. The heat exchanger according to claim 1, wherein the louvers have bases connected to the planar portion, and lengths of the bases along the planar portion are equal to one another in the louvers.

4. The heat exchanger according to claim 1, wherein the louvers are identical with one another in regard to a louver side-end angle between the side end and the planar portion regardless of the louver height.

5. A method for manufacturing a heat exchanger including:

tubes through which a first fluid flows; and a fin bonded to the tubes to promote heat exchange between the first fluid and a second fluid that flows along one direction through spaces among the tubes, the fin including a planar portion having a plate-like shape along the one direction, and louvers aligned in the one direction on the planar portion and inclined with respect to the planar portion, the manufacturing method comprising a step of manufacturing the fin by a roller shaping method, wherein the step includes a fin shaping step of making a fin material into a corrugated shape and shaping the louvers by letting the fin material be bitten by a pair of gear-like shaping rollers, the fin shaping step includes:

using the shaping rollers including louver-shaping cutting blades aligned in a row in an axial direction of the shaping rollers, the louver-shaping cutting blades including a high cutting blade and a low cutting blade that is lower than the high cutting blade in a cutting blade height from a tooth flank to a cutting blade tip end, the high cutting blade being shorter than the low cutting blade in a length at the cutting blade tip end;

shaping the louvers by making the louver-shaping cutting blades start to cut in the fin material at same timing with one another, and shaping the louvers by using the shaping rollers in which the high cutting blade is larger than the low cutting blade in a radius of curvature of an outer shape of a cutting blade tip end corner at which the cutting-blade side end intersects with the cutting blade tip end.

6. The manufacturing method of a heat exchanger according to claim 5, wherein the fin shaping step includes shaping the louvers by using the shaping rollers in which the high cutting blade is smaller than the low cutting blade in a cutting-blade side-end angle between a cutting-blade side end and the tooth flank.

7. The manufacturing method of a heat exchanger according to claim 1, wherein the fin shaping step includes shaping the louvers by using the shaping rollers in which the louver-shaping cutting blades have equal lengths of cutting blade bases along which the louver-shaping cutting blades are connected to the tooth flank.

8. The heat exchanger according to claim 1, wherein the fin includes a first flat portion, a second flat portion and a third flat portion disposed sequentially from upstream in a flow of the second fluid in the one direction, the louvers include:

first louvers aligned in the one direction between the first flat portion and the second flat portion and inclined with respect to the one direction; and second louvers aligned in the one direction between the second flat portion and the third flat portion at a louver pitch equal to a louver pitch of the first louvers and inclined with respect to the one direction in an opposite orientation to the first louvers, a length of the fin in the one direction is shorter than or equal to 14 mm, the first louvers include an upstream-end first louver connected to the first flat portion, the second louvers include an upstream-end second louver connected to the second flat portion, and a louver length in the one direction of each of the upstream-end first louver and the upstream-end second louver is longer than or equal to ⅝ x LP, where LP is the louver pitch.

9. The heat exchanger according to claim 8, wherein the louver length of each of the upstream-end first louver and the upstream-end second louver is longer than or equal to ⅞×LP or shorter, where the LP is the louver pitch.

10. The heat exchanger according to claim 8, wherein the louver length of each of the upstream-end first louver and the upstream-end second louver is longer than or equal to ¾×LP, where the LP is the louver pitch.

11. The heat exchanger according to claim 8, wherein the first louvers include a downstream-end first louver connected to the second flat portion, the second louvers include a downstream-end second louver connected to the third flat portion, and louver lengths of the upstream-end first louver, the upstream-end second louver, the downstream-end first louver, and the downstream-end second louver are equal to one another.

12. The heat exchanger according to claim 11, wherein the first louvers include an intermediate first louver located between the upstream-end first louver and the downstream-end first louver, the second louvers include an intermediate second louver located between the upstream-end second louver and the downstream-end second louver, and each of the upstream-end first louver, the downstream-end first louver, the upstream-end second louver and the downstream-end second louver is higher than the intermediate first louver and the intermediate second louver in a louver height in a louver-height direction orthogonal to a surface of the first flat portion provided along the one direction.

13. The heat exchanger according to claim 11, wherein a coupling portion of the upstream-end first louver and the first flat portion, a coupling portion of the downstream-end first louver and the second flat portion, a coupling portion of the upstream-end second louver and the second flat portion, and a coupling portion of the downstream-end second louver and the third flat portion each have a curved shape.

14. The heat exchanger according to claim 1, wherein:

the planar portion includes a first flat portion, a second flat portion, and a third flat portion disposed sequentially from upstream in a flow of the second fluid in the one direction;

the louvers include:

first louvers aligned in the one direction between the first flat portion and the second flat portion and inclined with respect to the one direction; and second louvers aligned in the one direction between the second flat portion and the third flat portion at a louver pitch equal to a louver pitch of the first louvers and inclined with respect to the one direction in an opposite orientation to the first louvers, the first louvers include an upstream-end first louver connected to the first flat portion, a downstream-end first louver connected to the second flat portion, and an intermediate first louver located between the upstream-end first louver and the downstream-end first louver, the second louvers include an upstream-end second louver connected to the second flat portion, a downstream-end second louver connected to the third flat portion, and an intermediate second louver located between the upstream-end second louver and the downstream-end second louver, and the upstream-end first louver, the downstream-end first louver, the upstream-end second louver and the downstream-end second louver are larger in an inclination angle with respect to the one direction than the intermediate first louver and the intermediate second louver.

15. The heat exchanger according to claim 1, wherein:

the planar portion includes a first flat portion, a second flat portion and a third flat portion, each of which has a plate-like shape, disposed sequentially from upstream in a flow of the second fluid in the one direction, the louvers include:

first louvers aligned in the one direction between the first flat portion and the second flat portion and inclined with respect to the one direction, second louvers aligned in the one direction between the second flat portion and the third flat portion at a louver pitch equal to a louver pitch of the first louvers and inclined with respect to the one direction in an opposite orientation to the first louvers, and a connection portion having plate-like shape and extending in the one direction, the connection portion integrally connecting the first flat portion, the first louvers, the second flat portion, the second louvers and the third flat portion, each of the first flat portion, the second flat portion and the third flat portion is disposed so as to be displaced from the connection portion in a thickness direction of the connection portion, the first louvers define first inter-louver passages between the first louvers such that passages of the first inter-louver passages which are positioned on an uppermost stream side and a lowermost stream side in an air flow are wider than other passages of the first inter-louver passages, and the second louvers define second inter-louver passages between the second louvers such that passages of the second inter-louver passages, which are positioned on an uppermost stream side and a lowermost stream side in the air flow, are wider than other passages of the second inter-louver passages.

16. The heat exchanger according to claim 8, wherein the first louvers are parallel to one another, and the second louvers are parallel to one another.

17. The heat exchanger according to claim 8, wherein a whole of the first louvers and a whole of the second louvers are in a symmetrical relation with each other with respect to the second flat portion.

* * * * *